US009075374B2

(12) United States Patent
Aviv et al.

(10) Patent No.: US 9,075,374 B2
(45) Date of Patent: Jul. 7, 2015

(54) METHOD AND APPARATUS FOR ASSESSING THE OPERATION OF A COLOR PRINTING SYSTEM

(75) Inventors: Maya Aviv, Ness Ziona (IL); Gennady Meltser, Kiryat-Gat (IL); Yuri Sapozhnikov, Ness Ziona (IL); Shai Druckman, Ness Ziona (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 187 days.

(21) Appl. No.: 13/811,276

(22) PCT Filed: Jul. 20, 2010

(86) PCT No.: PCT/EP2010/060510

§ 371 (c)(1), (2), (4) Date: May 26, 2013

(87) PCT Pub. No.: WO2012/010202

PCT Pub. Date: Jan. 26, 2012

(65) Prior Publication Data

US 2013/0259542 A1 Oct. 3, 2013

(51) Int. Cl.
*G03G 15/01* (2006.01)
*G03G 15/00* (2006.01)

(52) U.S. Cl.
CPC ..... *G03G 15/55* (2013.01); *G03G 15/0131* (2013.01); *G03G 15/5062* (2013.01); *G03G 2215/0161* (2013.01)

(58) Field of Classification Search
CPC ..... G03G 2215/0161; G03G 15/0131; G03G 15/5033; G03G 15/5062
USPC ..... 399/49, 72, 301
See application file for complete search history.

(56) References Cited

U.S. PATENT DOCUMENTS

| | | | | |
|---|---|---|---|---|
| 5,521,844 | A | 5/1996 | Karis | |
| 6,563,524 | B1 | 5/2003 | Regimbal et al. | |
| 6,782,814 | B2 | 8/2004 | Tokiwa | |
| 7,516,040 | B2 | 4/2009 | Leute et al. | |
| 7,519,222 | B2 | 4/2009 | Kisilev et al. | |
| 7,616,918 | B2 * | 11/2009 | Jeon | 399/301 |
| 2005/0286742 | A1 | 12/2005 | Rasmussen et al. | |

(Continued)

FOREIGN PATENT DOCUMENTS

JP 60056563 A 4/1985

OTHER PUBLICATIONS

International search report and written opinion in counterpart PCT patent application PCT/EP2010/060510, Mar. 16, 2011.

*Primary Examiner* — Hoang Ngo

(57) ABSTRACT

A method and apparatus are provided for assessing the operation of a col or printing system (10) by measuring color plane mis-registration. The printing system (10) is caused to print a multi-sheet test job (26) with corresponding test points on each sheet distributed vertically and horizontally over the sheet. The test points comprise test markings for determining horizontal and vertical color plane mis-registration values. These test markings are measured by an imaging subsystem (30) to determine horizontal and vertical color plane mis-registration values (31) for the printing colors. The mis-registration values are then analyzed (33, 36) by a processing subsystem (32) to derive a plurality of mis-registration parameters that provide different respective views of mis-registration behaviour across the test sheets. An output is provided based on the mis-registration parameters.

14 Claims, 22 Drawing Sheets

$Y_MR_H$ : $\Delta_H Y - Offset_H$
$M_MR_H$ : $\Delta_H M - Offset_H$
$C_MR_H$ : $\Delta_H C - Offset_H$ $Y_MR_V$ : $\Delta_V Y - Offset_V$
$M_MR_V$ : $\Delta_V M - Offset_V$
$C_MR_V$ : $\Delta_V C - Offset_V$

(56) References Cited

U.S. PATENT DOCUMENTS

| | | | | |
|---|---|---|---|---|
| 2007/0003109 | A1 | 1/2007 | Wu et al. | |
| 2008/0079797 | A1 | 4/2008 | Sagi et al. | |
| 2008/0226361 | A1 * | 9/2008 | Tomita et al. | 399/301 |
| 2008/0246987 | A1 | 10/2008 | Scrafford et al. | |
| 2009/0154766 | A1 | 6/2009 | Quine et al. | |
| 2009/0274342 | A1 | 11/2009 | Wu et al. | |

* cited by examiner

Y_MR$_H$ : $\Delta_H Y - \text{Offset}_H$

M_MR$_H$ : $\Delta_H M - \text{Offset}_H$

C_MR$_H$ : $\Delta_H C - \text{Offset}_H$

Y_MR$_V$ : $\Delta_V Y - \text{Offset}_V$

M_MR$_V$: $\Delta_V M - \text{Offset}_V$

C_MR$_V$ : $\Delta_V C - \text{Offset}_V$

BASIC CPR PARAMETERS

Table 1 – BASIC H&V MR VALUES

MR = Measured misregistration ($Y_MR_{H}$, $M_MR_{H}$, $C_MR_{H}$, and $Y_MR_{V}$, $M_MR_{V}$, $C_MR_{V}$,)

RESPECTIVE SUB-TABLE OF:

8(pages)* 3(positions) *12(locations)*3(colors y/m/c) = 864 ROWS:

| _page | _position | _location | _color | ***Basic MR*** |
|---|---|---|---|---|

FOR EACH OF

Basic Horizontal (Hbasic)

Basic Vertical (Vbasic)

Table 2 – CMR values

CMR = max( |Y_MR|, |M_MR|, |C_MR|, |Y_MR - M_MR|, |Y_MR - C_MR|, |M_MR - C_MR| )

RESPECTIVE SUB-TABLE OF 4(pages) *3(positions) *12(locations) = 144 ROWS:

| _page | _ position | _location | ***CMR*** |
|---|---|---|---|

FOR EACH OF:

Simplex Horizontal CMR (SHCMR)

Simplex Vertical CMR (SVCMR)

Duplex Horizontal CMR (DHCMR)

Duplex Vertical CMR (DVCMR)

Table 3 – MR_Range Per Point

MR_RangePerPoint = $Max_{4_page}$(HBasic/VBasic) –$Min_{4_pages}$ (HBasic/VBasic)

RESPECTIVE SUB-TABLE OF 3(positions)*12(locations)* 3(colors y/m/c) = 108 ROWS:

| _ position | _location | _color | ***MR_RangePerPoint*** |
|---|---|---|---|

FOR EACH OF:

Simplex Horizontal MR_RangePerPoint (SHMR_RangePerPoint)

Simplex Vertical MR_RangePerPoint (SVMR_RangePerPoint)

Duplex Horizontal MR_RangePerPoint (DHMR_RangePerPoint)

Duplex Vertical MR_RangePerPoint (DVMR_RangePerPoint)

Table 4 – MR_Av Per Point

MR_AvPerPoint = ($Max_{4_page}$(HBasic/VBasic) +$Min_{4_pages}$ (HBasic/VBasic))/2

RESPECTIVE SUB-TABLE OF 3(positions)*12(locations)* 3(colors y/m/c) = 108 ROWS:

| _ position | _location | _color | ***MR_AvPerPoint*** |
|---|---|---|---|

FOR EACH OF:

Simplex Horizontal MR_AvPerPoint (SHMR_AvPerPoint)

Simplex Vertical MR_AvPerPoint (SVMR_AvPerPoint)

Duplex Horizontal MR_AvPerPoint (DHMR_AvPerPoint)

Duplex Vertical MR_AvPerPoint (DVMR_AvPerPoint)

Figure 5

YELLOW VALIDATION

Table 5 – Dress

DRESS = ABS(L-$R_{12_locations}$ (yellow(SHBasic/DHBasic)))

RESPECTIVE SUB-TABLE OF 4(pages)*12(locations) = 48 ROWS:

| _ page | _ location | ***DRESS*** |
|---|---|---|

FOR EACH OF:
Simplex Horizontal Dress (SHDress)
Duplex Horizontal Dress (DHDress)

Table 6 – MaxDress

MaxDress = $max_{12_locations}$(SHDress/ DHDress)

RESPECTIVE SUB-TABLE OF 4(pages) ROWS:

| _ page | ***MaxDress*** |
|---|---|

FOR EACH OF:
Simplex Horizontal MaxDress (SHMaxDress)
Duplex Horizontal MaxDress (DHMaxDress)

Table 7 – Jacket yellowLC =ABS( L-$C_{12_locations}$ (yellow(SVBasic/DVBasic)))
yellowRC =ABS( R-$C_{12_locations}$ (yellow(SVBasic/DVBasic)))

RESPECTIVE SUB-TABLE OF 4(pages)*12(locations) = 48 ROWS:

| _ page | _location | ***yellowLC*** | ***yellowRC*** |
|---|---|---|---|

FOR EACH OF:
Simplex Vertical Jacket (SVJacket)
Duplex Vertical Jacket (DVJacket)

Table 8 – MaxJacket

MaxJacket = $max_{12_locations}$(yellowLC, yellowRC)

RESPECTIVE SUB-TABLE OF 4(pages) ROWS:

| _page | ***MaxJacket*** |
|---|---|

FOR EACH OF:
Simplex Vertical MaxJacket (SVMaxJacket)
Duplex Vertical MaxJacket (DVMaxJacket)

Figure 6

SHIFT CALCULATION

Table 9 – Vertical shifts

VShift =

$(Max_{4_page,\ 36_points}(SVBasic/\ DVBasic) + Min_{4_pages,\ 36_points}(SVBasic\ /\ DVBasic))\ /\ 2$ RESPECTIVE SUB-TABLE OF 3(colors y/m/c) = 3 ROWS:

| _color | ***VShift*** |
|---|---|

FOR EACH OF:

Simplex Vertical Shifts (SVShifts)
Duplex Vertical Shifts (DVShifts)

Table 10 – Vertical Shift Range

VShiftRange =

$(Max_{4_page,\ 36_points}(SVBasic/\ DVBasic) - Min_{4_pages,\ 36_points}\ (SVBasic\ /\ DVBasic))$ RESPECTIVE SUB-TABLE OF 3(colors y/m/c) = 3 ROWS:

| _color | ***VShiftRange*** |
|---|---|

FOR EACH OF:

Simplex Vertical Shifts (SVShiftRange)
Duplex Vertical Shifts (DVShiftRange)

Table 11 – Horizontal shifts

Calculate HShift using the L and R test points down the simplex/duplex pages $x_l = (Max_{12locations,\ 4\ pages,\ L\ only}(\mathbf{SHBasic/DHBasic}) + Min_{12locations,\ 4\ pages,\ L\ only}\ (\mathbf{SHBasic/DHBasic}))/2$
$x_r = (Max_{12locations,\ 4\ pages,\ R\ only}(\mathbf{SHBasic/DHBasic}) + Min_{12locations,\ 4\ pages,\ R\ only}(\mathbf{SHBasic/DHBasic}))/2$ Right HShift = Sign(x_r) * 60 * Round((abs(x_r) + 29/500)/60,0)
Left HShift = 30 * Round(x_l/30 + (Sign(x_l) * 0.5))

RESPECTIVE SUB-TABLE OF 2(positions R & L)* 3(colors y/m/c) = 6 ROWS:

| _ position | _ color | ***HShift*** |
|---|---|---|

FOR EACH OF:

Simplex Horizontal Shifts (SHShifts)
Duplex Horizontal Shifts (DHShifts)

Figure 7A

SHIFT APPLICATION

Table 12 – Vertical Basic After Shift

VBasicAfterShift = VBasic – SVShifts\DVShifts

ONE TABLE OF 8(pages)* 3(positions) *12(locations)*3(colors y/m/c) = 864 ROWS

| _page | _position | _location | _color | *VBasicAfterShift* |
|---|---|---|---|---|

Table 13 – Vertical CMR After Shift

Calculate CMR on VBasicAfterShift

RESPECTIVE SUB-TABLE OF 4(pages) *3(positions) *12(locations) = 144 ROWS:

| _page | _ position | _location | *CMRAfterShift* |
|---|---|---|---|

FOR EACH OF:
SVCMRAfterShift
DVCMRAfterShift

Table 14 – Horizontal Basic After Shift

Right and Left only:
HBasicAfterShift = HBasic – SHShift\DHShift (L points with L Shift, R points with R Shift)

ONE TABLE WITH 8(pages)* 3(positions) *12(locations)*3(colors y/m/c) = 864 ROWS

| _page | _position | _location | _color | *HBasicAfterShift* |
|---|---|---|---|---|

Table 15 – Horizontal CMR After Shift

Calculate CMR on HBasicAfterShift

RESPECTIVE SUB-TABLE OF 4(pages) *3(positions) *12(locations) = 144 ROWS:

| _page | _ position | _location | *CMRAfterShift* |
|---|---|---|---|

FOR EACH OF:
SHCMRAfterShift
DHCMRAfterShift

Figure 7B

THETA PROCESSING

Table 16 – theta values

Y_theta = $Y_MR_V$ - $C_MR_V$
M_theta = $M_MR_V$ - $C_MR_V$
K_theta = - $C_MR_V$ ONE TABLE OF: 8*434*3 = 10416 ROWS (5208 in Simplex/ mode)

| _page | _location | _color | *theta* |
|---|---|---|---|

Table 17 – average theta values

Y_avjTheta = avj(Y_theta(Theta))
M_avjTheta = avj(M_theta(Theta))
K_avjTheta = avj(K_theta(Theta))

RESPECTIVE SUB-TABLE OF 4 pages*3 colors = 12 ROWS:

| _page | _color | *avjTheta* |
|---|---|---|

FOR EACH OF: SThetaAvj; DThetaAvj

Table 18 – dist theta values thetaDist = ABS(Theta - avjTheta)

RESPECTIVE SUB-TABLE OF 4 pages*434 locations*3 colors = 5208 ROWS:

| _page | _location | _color | *thetaDist* |
|---|---|---|---|

FOR EACH OF: SThetaDist; DThetaDist

Table 19 – theta percentage

Per page per colors, how many thetaDist values fall within the range 20 (microns)

RESPECTIVE SUB-TABLE OF 4 pages*3 colors = 12 ROWS:

| _page | _color | *%theta* |
|---|---|---|

FOR EACH OF: SThetaPerc; DThetaPerc

Table 20 – Least Squares Fitting

Determine Least Squares Fitting P olynomial for Table 16 data
Degree = 0 – 3

RESPECTIVE SUB-TABLE OF 4 pages*3 colors *4 orders = 48 ROWS:

| _page | _color | degree | *a0* | *a1* | *a2* | *a3* | $R^2$ |
|---|---|---|---|---|---|---|---|

FOR EACH OF: SLeastSquaresFitting ; DLeastSquaresFitting

Figure 8A

THETA PROCESSING

Table 21 – Fourier Transform of Theta Values

Using theta values from Table16, for 2nd page, color = Y, M, K
calculate FT for 300 frequencies, RESPECTIVE SUB-TABLE OF 300 frequencies = 300 ROWS:

| Frequency | ***Amplitude*** |
|---|---|

FOR EACH OF: FT-Y: FT-M; FT-K

Figure 8B

100

| SPEC and C_limit list | | | | | |
|---|---|---|---|---|---|
| Quantity | | | Units | SPEC | C_LIMIT |
| **MR** | | | | | |
| H | C | YMC | microns | - | 100 |
| H | LR | MC | microns | - | 100 |
| H | LR | Y | microns | - | 250 |
| V | C | YMC | microns | - | 500 |
| V | LR | MC | microns | - | 500 |
| V | LR | Y | microns | - | 500 |
| **CMR** | | | | | |
| H | | | microns | 100 | 100 |
| V | | | microns | 120 | 60 |
| Out of C_Limit | | | % | 15 | 10 |
| **MR_Range per point** | | | | | |
| H | Y | | microns | 100 | 60 |
| H | MC | | microns | 100 | 60 |
| V | Y | | microns | 100 | 60 |
| V | MC | | microns | 100 | 60 |
| **MR_Av per point** | | | | | |
| H | Y | | microns | 150 | 100 |
| H | MC | | microns | 150 | 100 |
| V | Y | | microns | 150 | 100 |
| V | MC | | microns | 150 | 100 |
| | | | microns | 70 | 40 |
| HShift | | | Microns | 200 | 100 |
| VShift | | | Microns | 150 | 100 |
| **Theta** | | | | | |
| Theta | | | % | 80 | 85 |
| Theta Angle | | | deg | 20 | 15 |
| Theta Parabola raise | | | microns | 30 | 20 |
| **Theta main freq.** | | | | | |
| - 1st harmonic | | | | 2000 | 1500 |
| - 2nd harmonic | | | | 2750 | 2000 |
| - 3rd harmonic | | | | 2200 | 1500 |
| - 4th harmonic | | | | 4000 | 3000 |
| Theta all freq | | | | 1000 | 1000 |

Figure 10

110

CPR REPORT MAIN PAGE

Preliminary validation on Mis-Registration results 111

| | Direction | Position | Color | Units | Value | C_limit |
|---|---|---|---|---|---|---|
| % of points with high MR values | Horizontal | Center | All | % | 2 | 95 |
| | | Sides | Y | % | 0 | 210 |
| | | | C, M | % | 0 | 95 |
| | Vertical | All | All | % | 0 | 210 |

*REJECT! High H MR at page center (Ref: xx)*

211

Theta – Magenta Color (2nd page) 112A

| | Units | Value | C_Limit | Spec |
|---|---|---|---|---|
| **Theta** - % of MR points in the interval of: Ave±20 microns | % | 100 | 85 | 80 |
| **Theta linear fit angle** | Degrees | 0 | 25 | 35 |
| **Theta parabola raise** | Degrees | 5 | 45 | 55 |

| | |
|---|---|
| **Frequencies in Spec ?** | Yes |

112B

CMR – Summary 113

| | Units | Before Shift | After Shift | C_Limit | Spec |
|---|---|---|---|---|---|
| **Max CMR** | Microns | 150 | 120 | 110 | 130 |
| **% of CMR values** out of C_limit | % | 10 | 1 | 10 | 15 |

*High CMR values detected – refer to Full CMR report page*

213

Maximum Shift 114

| | Units | Max shift | C_Limit | Spec |
|---|---|---|---|---|
| **Full Report –** 36 points/page | Microns | 78 | 150 | 200 |

Random MR between pages 115

| MR_Range Per Point | Units | Color | Randomly | C_Limit | Spec |
|---|---|---|---|---|---|
| **Vertical Direction** | Microns | Y | 26 | 100 | 150 |
| | | C, M | 18 | 60 | 100 |
| **Horizontal Direction** | Microns | Y | 59 | 100 | 150 |
| | | C, M | 29 | 60 | 100 |

116

| Recommended Vertical Shift | Y | M | C |
|---|---|---|---|
| Simplex | 4 | 17 | -3 |
| Duplex | 78 | 56 | 14 |

Green
Amber
Red

Figure 11

Full CMR Report Page
(1)

121

| | | Maximum CMR | | | |
|---|---|---|---|---|---|
| | | Direction | Value | C.limit | SPEC |
| Before shift | Simplex | HCMR | 120 | 110 | 130 |
| | | VCMR | 45 | 110 | 130 |
| | Duplex | HCMR | 94 | 110 | 130 |
| | | VCMR | 150 | 110 | 130 |
| After shift | Simplex | HCMR | 120 | 110 | 130 |
| | | VCMR | 35 | 110 | 130 |
| | Duplex | HCMR | 75 | 110 | 130 |
| | | VCMR | 71 | 110 | 130 |

*High CMR values detected*

122

| % of CMR values OUT OF C. Limit | | Direction | Amount | SUM | % of 576 CMR results | C.Limit | Spec |
|---|---|---|---|---|---|---|---|
| Before shift | Simplex | HCMR | 10 | 56 | 10% | N/A | N/A |
| | | VCMR | 0 | | | | |
| | Duplex | HCMR | 0 | | | | |
| | | VCMR | 46 | | | | |
| After shift | Simplex | HCMR | 7 | 7 | 1% | | 15% |
| | | VCMR | 0 | | | | |
| | Duplex | HCMR | 0 | | | | |
| | | VCMR | 0 | | | | |

123

| | | | % of fails C.limit | | | | % of fails SPEC | | | |
|---|---|---|---|---|---|---|---|---|---|---|
| | | Direction | All | LE | Mid | TE | All | LE | Mid | TE |
| Before shift | Simplex | HCMR | 7% | 0% | 4% | 25% | 0% | 0% | 0% | 0% |
| | | VCMR | 0% | 0% | 0% | 0% | 0% | 0% | 0% | 0% |
| | Duplex | HCMR | 0% | 0% | 0% | 0% | 0% | 0% | 0% | 0% |
| | | VCMR | 32% | 0% | 31% | 67% | 13% | 0% | 11% | 29% |
| After shift | Simplex | HCMR | 5% | 0% | 3% | 17% | 0% | 0% | 0% | 0% |
| | | VCMR | 0% | 0% | 0% | 0% | 0% | 0% | 0% | 0% |
| | Duplex | HCMR | 0% | 0% | 0% | 0% | 0% | 0% | 0% | 0% |
| | | VCMR | 0% | 0% | 0% | 0% | 0% | 0% | 0% | 0% |

*High % CMR Spec failures detected*

Figure 12A

Full CMR Report Page
(2)

124

| State | Direction | Page Area | | CMR Full Report - Simplex | | | | | | | | | | | |
|---|---|---|---|---|---|---|---|---|---|---|---|---|---|---|---|
| | | | BG | 0% | | | 100% Cyan | | | 100% Magenta | | | 400% YMCK | | |
| | | | | Position | | | Position | | | Position | | | Position | | |
| | | | Point | L | C | R | L | C | R | L | C | R | L | C | R |
| Before Shift | HMPR | LE | 1 | 36 | 34 | 33 | 13 | 22 | 27 | 16 | 33 | 29 | 31 | 36 | 38 |
| | | | 2 | 9 | 42 | 29 | 12 | 27 | 44 | 16 | 43 | 23 | 28 | 41 | 43 |
| | | Mid | 3 | 8 | 45 | 35 | 13 | 46 | 54 | 11 | 47 | 32 | 33 | 50 | 51 |
| | | | 4 | 5 | 53 | 52 | 13 | 51 | 61 | 15 | 59 | 56 | 30 | 62 | 59 |
| | | | 5 | 6 | 66 | 75 | 15 | 63 | 72 | 15 | 63 | 73 | 38 | 73 | 73 |
| | | | 6 | 13 | 73 | 94 | 17 | 75 | 81 | 20 | 80 | 96 | 48 | 87 | 84 |
| | | | 7 | 18 | 87 | 101 | 21 | 83 | 93 | 23 | 87 | 105 | 49 | 99 | 88 |
| | | | 8 | 27 | 96 | 99 | 26 | 91 | 87 | 28 | 95 | 104 | 53 | 106 | 79 |
| | | | 9 | 41 | 100 | 105 | 35 | 98 | 86 | 41 | 98 | 95 | 58 | 112 | 66 |
| | | | 10 | 58 | [illegible] | [illegible] | 53 | 106 | 99 | 56 | 109 | 104 | 74 | [illegible] | 79 |
| | | TE | 11 | 72 | [illegible] | 112 | 68 | 110 | 88 | 71 | 107 | 88 | 87 | [illegible] | 84 |
| | | | 12 | 105 | [illegible] | 53 | 100 | 102 | 76 | 88 | 103 | 71 | [illegible] | [illegible] | 61 |
| | VCMR | LE | 1 | 18 | 16 | 22 | 19 | 16 | 31 | 23 | 21 | 24 | 22 | 17 | 24 |
| | | | 2 | 27 | 9 | 24 | 26 | 15 | 24 | 34 | 19 | 28 | 42 | 12 | 25 |
| | | mid | 3 | 42 | 24 | 24 | 35 | 25 | 23 | 45 | 24 | 29 | 41 | 22 | 32 |
| | | | 4 | 37 | 26 | 29 | 34 | 28 | 25 | 39 | 21 | 26 | 37 | 18 | 27 |
| | | | 5 | 25 | 23 | 21 | 22 | 24 | 15 | 32 | 19 | 22 | 36 | 12 | 21 |
| | | | 6 | 18 | 28 | 17 | 23 | 26 | 23 | 29 | 21 | 23 | 22 | 12 | 21 |
| | | | 7 | 13 | 23 | 22 | 14 | 21 | 18 | 28 | 15 | 23 | 18 | 13 | 20 |
| | | | 8 | 18 | 21 | 33 | 25 | 15 | 29 | 26 | 19 | 22 | 29 | 19 | 29 |
| | | | 9 | 24 | 33 | 45 | 26 | 24 | 41 | 36 | 26 | 36 | 39 | 23 | 45 |
| | | | 10 | 23 | 27 | 41 | 38 | 21 | 46 | 39 | 23 | 34 | 36 | 25 | 48 |
| | | TE | 11 | 26 | 23 | 32 | 39 | 18 | 33 | 43 | 24 | 27 | 37 | 18 | 33 |
| | | | 12 | 25 | 34 | 35 | 32 | 21 | 31 | 38 | 25 | 26 | 30 | 25 | 41 |
| After Shift | HMPR | LE | 1 | 10 | 34 | 29 | 9 | 22 | 17 | 9 | 30 | 31 | 16 | 36 | 16 |
| | | | 2 | 13 | 42 | 31 | 19 | 27 | 12 | 16 | 43 | 33 | 15 | 41 | 18 |
| | | Mid | 3 | 14 | 45 | 27 | 21 | 40 | 11 | 16 | 47 | 27 | 21 | 50 | 15 |
| | | | 4 | 13 | 53 | 11 | 19 | 51 | 8 | 17 | 59 | 17 | 18 | 62 | 11 |
| | | | 5 | 13 | 66 | 13 | 18 | 63 | 15 | 18 | 63 | 29 | 26 | 73 | 19 |
| | | | 6 | 5 | 73 | 24 | 16 | 75 | 14 | 18 | 80 | 26 | 34 | 87 | 20 |
| | | | 7 | 9 | 87 | 24 | 15 | 83 | 13 | 22 | 87 | 26 | 32 | 99 | 24 |
| | | | 8 | 19 | 90 | 18 | 11 | 91 | 6 | 17 | 95 | 22 | 30 | 106 | 22 |
| | | | 9 | 16 | 100 | 17 | 19 | 98 | 11 | 21 | 98 | 22 | 36 | 112 | 37 |
| | | | 10 | 17 | [illegible] | 23 | 22 | 106 | 16 | 27 | 109 | 22 | 32 | [illegible] | 26 |
| | | TE | 11 | 21 | [illegible] | 36 | 25 | 110 | 23 | 28 | 107 | 23 | 38 | [illegible] | 22 |
| | | | 12 | 30 | [illegible] | 27 | 28 | 102 | 10 | 32 | 100 | 18 | 43 | [illegible] | 25 |
| | VMPR | LE | 1 | 11 | 16 | 9 | 14 | 12 | 26 | 15 | 17 | 10 | 18 | 16 | 20 |
| | | | 2 | 18 | 12 | 13 | 13 | 14 | 16 | 21 | 9 | 13 | 36 | 10 | 14 |
| | | Mid | 3 | 32 | 23 | 24 | 27 | 25 | 15 | 32 | 11 | 14 | 28 | 12 | 22 |
| | | | 4 | 33 | 28 | 20 | 21 | 25 | 12 | 26 | 10 | 20 | 26 | 10 | 13 |
| | | | 5 | 26 | 27 | 22 | 16 | 25 | 14 | 19 | 10 | 16 | 24 | 11 | 11 |
| | | | 6 | 9 | 28 | 10 | 6 | 28 | 12 | 13 | 20 | 6 | 11 | 16 | 7 |
| | | | 7 | 9 | 23 | 25 | 10 | 26 | 11 | 14 | 15 | 6 | 6 | 13 | 14 |
| | | | 8 | 9 | 24 | 34 | 22 | 22 | 21 | 19 | 20 | 14 | 16 | 12 | 23 |
| | | | 9 | 13 | 29 | 38 | 28 | 23 | 29 | 23 | 20 | 25 | 37 | 11 | 37 |
| | | | 10 | 17 | 23 | 30 | 34 | 20 | 33 | 35 | 16 | 22 | 31 | 12 | 30 |
| | | TE | 11 | 22 | 20 | 28 | 35 | 13 | 30 | 38 | 14 | 17 | 33 | 6 | 28 |
| | | | 12 | 15 | 28 | 32 | 28 | 21 | 35 | 34 | 12 | 23 | 22 | 13 | 34 |

Figure 12B

125

Full CMR Report Page
(3)

| State | Direction | Page Area | | CMR Full Report - Duplex | | | | | | | | | | | |
|---|---|---|---|---|---|---|---|---|---|---|---|---|---|---|---|
| | | | BG | 0% | | | 100% Cyan | | | 100% Magenta | | | 400% YMCK | | |
| | | | | Position | | | Position | | | Position | | | Position | | |
| | | | Point | L | C | R | L | C | R | L | C | R | L | C | R |
| Before Shift | HCMR | LE | 1 | 27 | 17 | 49 | 31 | 22 | 43 | 42 | 11 | 32 | 37 | 17 | 49 |
| | | | 2 | 28 | 25 | 37 | 34 | 23 | 22 | 39 | 11 | 19 | 39 | 12 | 33 |
| | | Mid | 3 | 18 | 35 | 36 | 18 | 38 | 24 | 27 | 19 | 17 | 23 | 19 | 25 |
| | | | 4 | 10 | 38 | 34 | 9 | 40 | 24 | 20 | 28 | 15 | 11 | 29 | 25 |
| | | | 5 | 24 | 46 | 35 | 28 | 52 | 34 | 10 | 35 | 15 | 15 | 40 | 29 |
| | | | 6 | 39 | 54 | 34 | 45 | 64 | 37 | 25 | 37 | 23 | 36 | 50 | 37 |
| | | | 7 | 60 | 62 | 35 | 68 | 68 | 42 | 45 | 46 | 24 | 55 | 58 | 37 |
| | | | 8 | 71 | 68 | 37 | 81 | 73 | 44 | 59 | 55 | 29 | 72 | 67 | 42 |
| | | | 9 | 82 | 70 | 38 | 92 | 79 | 44 | 70 | 61 | 36 | 82 | 72 | 46 |
| | | | 10 | 82 | 67 | 39 | 94 | 79 | 43 | 70 | 57 | 37 | 88 | 70 | 42 |
| | | TE | 11 | 78 | 59 | 44 | 89 | 65 | 43 | 70 | 48 | 36 | 92 | 65 | 45 |
| | | | 12 | 51 | 57 | 50 | 76 | 51 | 55 | 54 | 42 | 38 | 77 | 59 | 50 |
| | VCMR | LE | 1 | 42 | 38 | 48 | 39 | 33 | 46 | 37 | 35 | 44 | 36 | 37 | 40 |
| | | | 2 | 41 | 39 | 60 | 41 | 37 | 53 | 41 | 34 | 53 | 47 | 40 | 52 |
| | | Mid | 3 | 51 | 48 | 72 | 51 | 45 | 71 | 49 | 42 | 67 | 55 | 44 | 75 |
| | | | 4 | 52 | 58 | 93 | 50 | 60 | 90 | 45 | 54 | 85 | 47 | 51 | 81 |
| | | | 5 | 71 | 72 | 106 | 71 | 71 | 102 | 67 | 68 | 103 | 66 | 61 | 97 |
| | | | 6 | 89 | 74 | 113 | 87 | 76 | 121 | 63 | 73 | 112 | 88 | 67 | 113 |
| | | | 7 | 102 | 80 | 128 | 100 | 84 | 122 | 95 | 76 | 127 | 96 | 76 | 128 |
| | | | 8 | 107 | 78 | 132 | 111 | 88 | 140 | 108 | 83 | 139 | 112 | 80 | 137 |
| | | | 9 | 112 | 76 | 135 | 110 | 76 | 136 | 115 | 79 | 141 | 115 | 71 | 126 |
| | | | 10 | 115 | 81 | 140 | 123 | 86 | 141 | 113 | 80 | 138 | 121 | 74 | 133 |
| | | TE | 11 | 121 | 88 | 146 | 126 | 97 | 150 | 123 | 92 | 146 | 127 | 83 | 135 |
| | | | 12 | 113 | 91 | 143 | 113 | 86 | 135 | 115 | 87 | 140 | 113 | 76 | 121 |
| After Shift | HCMR | LE | 1 | 11 | 17 | 34 | 15 | 22 | 27 | 14 | 11 | 22 | 9 | 17 | 36 |
| | | | 2 | 8 | 25 | 24 | 13 | 23 | 15 | 14 | 11 | 15 | 13 | 12 | 29 |
| | | Mid | 3 | 9 | 35 | 26 | 10 | 39 | 11 | 11 | 19 | 12 | 7 | 19 | 17 |
| | | | 4 | 10 | 38 | 20 | 9 | 40 | 10 | 18 | 20 | 13 | 9 | 29 | 22 |
| | | | 5 | 11 | 46 | 18 | 13 | 52 | 17 | 13 | 35 | 13 | 9 | 40 | 16 |
| | | | 6 | 8 | 54 | 14 | 11 | 64 | 17 | 19 | 37 | 14 | 11 | 50 | 16 |
| | | | 7 | 11 | 62 | 11 | 15 | 68 | 18 | 17 | 46 | 13 | 11 | 58 | 15 |
| | | | 8 | 13 | 68 | 10 | 21 | 78 | 17 | 22 | 55 | 16 | 13 | 67 | 19 |
| | | | 9 | 12 | 70 | 13 | 16 | 79 | 17 | 22 | 61 | 17 | 8 | 72 | 19 |
| | | | 10 | 12 | 67 | 27 | 17 | 70 | 18 | 25 | 57 | 28 | 12 | 70 | 18 |
| | | TE | 11 | 13 | 59 | 38 | 22 | 65 | 23 | 29 | 48 | 33 | 20 | 65 | 28 |
| | | | 12 | 11 | 57 | 43 | 28 | 51 | 43 | 27 | 42 | 33 | 20 | 59 | 38 |
| | VCMR | LE | 1 | 60 | 49 | 34 | 62 | 45 | 32 | 63 | 49 | 34 | 68 | 53 | 42 |
| | | | 2 | 60 | 43 | 19 | 66 | 46 | 26 | 70 | 49 | 28 | 71 | 54 | 33 |
| | | Mid | 3 | 46 | 37 | 19 | 52 | 34 | 18 | 55 | 46 | 19 | 66 | 45 | 27 |
| | | | 4 | 26 | 21 | 21 | 29 | 25 | 20 | 33 | 31 | 16 | 31 | 27 | 16 |
| | | | 5 | 7 | 20 | 30 | 8 | 22 | 26 | 12 | 19 | 33 | 12 | 18 | 29 |
| | | | 6 | 10 | 18 | 36 | 9 | 20 | 42 | 10 | 17 | 34 | 20 | 15 | 40 |
| | | | 7 | 28 | 14 | 49 | 22 | 21 | 50 | 17 | 13 | 49 | 26 | 17 | 49 |
| | | | 8 | 30 | 17 | 54 | 32 | 27 | 61 | 30 | 12 | 61 | 34 | 18 | 58 |
| | | | 9 | 35 | 14 | 56 | 32 | 21 | 57 | 37 | 13 | 63 | 37 | 19 | 47 |
| | | | 10 | 40 | 5 | 61 | 44 | 18 | 63 | 34 | 8 | 59 | 42 | 13 | 58 |
| | | TE | 11 | 49 | 11 | 67 | 48 | 22 | 71 | 45 | 13 | 67 | 48 | 5 | 56 |
| | | | 12 | 42 | 13 | 65 | 35 | 18 | 57 | 34 | 12 | 61 | 34 | 12 | 46 |

Figure 12C

Random Point Range Page
(1)

MR_Range-per-point

131

| Page Side | Separation: | | Yellow | | | Magenta | | | Cyan | | |
|---|---|---|---|---|---|---|---|---|---|---|---|
| | Page Area | Position | L | C | R | L | C | R | L | C | R |
| Simplex | LE | 1 | 11 | 11 | 23 | 8 | 11 | 6 | 7 | 10 | 7 |
| | | 2 | 15 | 19 | 19 | 16 | 14 | 5 | 5 | 8 | 5 |
| | Mid | 3 | 9 | 14 | 28 | 14 | 10 | 12 | 10 | 6 | 7 |
| | | 4 | 14 | 18 | 20 | 15 | 13 | 12 | 9 | 9 | 14 |
| | | 5 | 12 | 16 | 13 | 15 | 9 | 13 | 14 | 9 | 9 |
| | | 6 | 8 | 14 | 11 | 15 | 6 | 11 | 2 | 7 | 8 |
| | | 7 | 20 | 19 | 19 | 18 | 9 | 10 | 4 | 12 | 11 |
| | | 8 | 12 | 17 | 21 | 11 | 7 | 12 | 13 | 8 | 15 |
| | | 9 | 13 | 20 | 13 | 12 | 10 | 7 | 6 | 6 | 8 |
| | | 10 | 18 | 21 | 12 | 16 | 10 | 8 | 12 | 9 | 8 |
| | TE | 11 | 16 | 19 | 16 | 15 | 14 | 11 | 9 | 11 | 11 |
| | | 12 | 18 | 18 | 17 | 15 | 13 | 7 | 11 | 5 | 10 |
| Duplex | LE | 1 | 10 | 8 | 10 | 8 | 4 | 7 | 6 | 9 | 7 |
| | | 2 | 11 | 11 | 14 | 3 | 5 | 9 | 4 | 15 | 11 |
| | Mid | 3 | 10 | 11 | 8 | 7 | 7 | 7 | 11 | 6 | 9 |
| | | 4 | 7 | 9 | 10 | 4 | 4 | 10 | 6 | 8 | 5 |
| | | 5 | 5 | 11 | 10 | 5 | 8 | 12 | 7 | 15 | 10 |
| | | 6 | 6 | 12 | 9 | 7 | 5 | 10 | 16 | 16 | 15 |
| | | 7 | 7 | 6 | 3 | 8 | 11 | 11 | 16 | 9 | 13 |
| | | 8 | 6 | 8 | 7 | 8 | 8 | 13 | 11 | 15 | 13 |
| | | 9 | 6 | 8 | 16 | 8 | 5 | 9 | 11 | 7 | 10 |
| | | 10 | 10 | 12 | 8 | 10 | 4 | 15 | 14 | 17 | 16 |
| | TE | 11 | 5 | 14 | 15 | 15 | 11 | 15 | 14 | 17 | 15 |
| | | 12 | 1 | 16 | 17 | 16 | 10 | 12 | 13 | 12 | 13 |
| C. Limit | | | 100 | | | 80 | | | | | |
| Spec | | | 150 | | | 100 | | | | | |

VMR_RangePerPoint

132

| Page Side | Separation: | | Yellow | | | Magenta | | | Cyan | | |
|---|---|---|---|---|---|---|---|---|---|---|---|
| | Page Area | Position | L | C | R | L | C | R | L | C | R |
| Simplex | LE | 1 | 16 | 14 | 22 | 19 | 21 | 16 | 19 | 16 | 13 |
| | | 2 | 23 | 15 | 22 | 21 | 28 | 20 | 13 | 15 | 15 |
| | Mid | 3 | 31 | 10 | 36 | 15 | 20 | 19 | 12 | 10 | 14 |
| | | 4 | 32 | 13 | 19 | 17 | 24 | 19 | 14 | 14 | 7 |
| | | 5 | 34 | 16 | 24 | 12 | 30 | 26 | 10 | 16 | 14 |
| | | 6 | 33 | 14 | 30 | 14 | 22 | 28 | 14 | 14 | 17 |
| | | 7 | 31 | 11 | 37 | 14 | 17 | 27 | 11 | 17 | 16 |
| | | 8 | 26 | 14 | 39 | 7 | 16 | 25 | 10 | 13 | 10 |
| | | 9 | 23 | 15 | 44 | 5 | 13 | 12 | 9 | 8 | 5 |
| | | 10 | 23 | 16 | 59 | 10 | 13 | 27 | 11 | 7 | 11 |
| | TE | 11 | 20 | 19 | 48 | 7 | 14 | 19 | 11 | 10 | 4 |
| | | 12 | 20 | 19 | 44 | 4 | 14 | 18 | 14 | 16 | 13 |
| Duplex | LE | 1 | 19 | 26 | 16 | 18 | 22 | 22 | 13 | 14 | 16 |
| | | 2 | 17 | 22 | 12 | 17 | 17 | 17 | 5 | 11 | 19 |
| | Mid | 3 | 14 | 25 | 17 | 13 | 14 | 15 | 7 | 6 | 12 |
| | | 4 | 17 | 23 | 20 | 13 | 14 | 19 | 5 | 10 | 19 |
| | | 5 | 18 | 23 | 22 | 15 | 17 | 17 | 7 | 5 | 8 |
| | | 6 | 23 | 32 | 27 | 17 | 17 | 17 | 3 | 11 | 13 |
| | | 7 | 22 | 21 | 31 | 16 | 18 | 17 | 7 | 6 | 9 |
| | | 8 | 22 | 24 | 28 | 16 | 19 | 17 | 6 | 10 | 10 |
| | | 9 | 21 | 18 | 17 | 15 | 14 | 14 | 6 | 10 | 15 |
| | | 10 | 24 | 17 | 18 | 9 | 11 | 12 | 9 | 10 | 18 |
| | TE | 11 | 23 | 22 | 19 | 12 | 16 | 19 | 18 | 16 | 29 |
| | | 12 | 23 | 17 | 24 | 19 | 17 | 17 | 15 | 14 | 23 |
| C. Limit | | | 100 | | | 80 | | | | | |
| Spec | | | 150 | | | 100 | | | | | |

HMR_RangePerPoint

Figure 13A

Random Point Range Page
(2)

MR_AvPerPoint

133

| Page Side | Separation: | | Yellow | | | Magenta | | | Cyan | | |
|---|---|---|---|---|---|---|---|---|---|---|---|
| | Page Area | Position | L | C | R | L | C | R | L | C | R |
| Simplex | LE | 1 | 9 | 16 | 14 | 19 | 12 | 13 | 10 | 0 | -9 |
| | | 2 | -11 | 4 | 1 | 21 | 12 | 10 | -5 | -2 | -14 |
| | Mid | 3 | -23 | -14 | -7 | 19 | 10 | 8 | -12 | -12 | -21 |
| | | 4 | -22 | -15 | -5 | 16 | 9 | 5 | -14 | -10 | -22 |
| | | 5 | -16 | -15 | -8 | 11 | 5 | 1 | -8 | -3 | -17 |
| | | 6 | 0 | -12 | -4 | 22 | 10 | 6 | -1 | 5 | -12 |
| | | 7 | 9 | -5 | -12 | 20 | 11 | 6 | 3 | 2 | -13 |
| | | 8 | 19 | 1 | -19 | 23 | 16 | 9 | 12 | 13 | -6 |
| | | 9 | 20 | -6 | -28 | 30 | 20 | 14 | 13 | 8 | -6 |
| | | 10 | 30 | -1 | -19 | 31 | 20 | 20 | 16 | 8 | -3 |
| | TE | 11 | 34 | -4 | -16 | 30 | 17 | 13 | 16 | 5 | -3 |
| | | 12 | 29 | -8 | -19 | 31 | 19 | 11 | 15 | 3 | 1 |
| Duplex | LE | 1 | 18 | 29 | 41 | 39 | 36 | 43 | 13 | 10 | 7 |
| | | 2 | 13 | 30 | 52 | 40 | 36 | 46 | -3 | 5 | -1 |
| | Mid | 3 | 28 | 39 | 65 | 45 | 45 | 50 | -7 | 0 | -9 |
| | | 4 | 49 | 55 | 85 | 45 | 50 | 53 | 3 | 17 | 3 |
| | | 5 | 69 | 66 | 103 | 49 | 58 | 60 | 5 | 21 | 8 |
| | | 6 | 86 | 72 | 116 | 53 | 62 | 67 | 11 | 25 | 18 |
| | | 7 | 98 | 80 | 126 | 53 | 60 | 66 | 14 | 31 | 17 |
| | | 8 | 110 | 82 | 135 | 58 | 62 | 69 | 22 | 33 | 23 |
| | | 9 | 113 | 75 | 130 | 59 | 61 | 67 | 26 | 29 | 19 |
| | | 10 | 113 | 80 | 137 | 58 | 62 | 71 | 24 | 21 | 18 |
| | TE | 11 | 124 | 90 | 142 | 57 | 63 | 70 | 27 | 27 | 23 |
| | | 12 | 113 | 83 | 136 | 57 | 63 | 73 | 23 | 23 | 26 |
| C. Limit | | | 100 | | | 100 | | | | | |
| Spec | | | 150 | | | 150 | | | | | |

VMR_AvPerPoint

134

| Page Side | Separation: | | Yellow | | | Magenta | | | Cyan | | |
|---|---|---|---|---|---|---|---|---|---|---|---|
| | Page Area | Position | L | C | R | L | C | R | L | C | R |
| Simplex | LE | 1 | -16 | -29 | -27 | 0 | -2 | -4 | -1 | -11 | -23 |
| | | 2 | -11 | -34 | -32 | 6 | -2 | -8 | -3 | -12 | -19 |
| | Mid | 3 | -12 | -40 | -36 | 4 | 2 | 0 | -3 | -6 | -12 |
| | | 4 | -19 | -50 | -51 | 6 | 4 | 4 | -1 | -4 | -7 |
| | | 5 | -11 | -58 | -63 | 9 | 2 | 9 | -1 | -1 | -4 |
| | | 6 | -19 | -70 | -79 | 11 | 7 | 7 | 3 | -1 | -6 |
| | | 7 | -16 | -75 | -83 | 16 | 10 | 10 | 4 | 3 | 2 |
| | | 8 | -24 | -84 | -79 | 14 | 10 | 8 | 5 | 4 | 5 |
| | | 9 | -31 | -85 | -68 | 19 | 14 | 16 | 7 | 7 | 8 |
| | | 10 | -40 | -95 | -63 | 22 | 15 | 12 | 8 | 6 | 5 |
| | TE | 11 | -53 | -92 | -88 | 25 | 18 | 12 | 13 | 7 | 2 |
| | | 12 | -76 | -88 | -63 | 29 | 17 | 12 | 20 | 11 | 2 |
| Duplex | LE | 1 | -26 | 6 | 18 | 6 | 0 | -5 | 7 | -10 | -27 |
| | | 2 | -26 | 10 | 9 | 5 | 1 | -3 | 5 | -7 | -19 |
| | Mid | 3 | -15 | 27 | 14 | 3 | 2 | -5 | 7 | -2 | -11 |
| | | 4 | -4 | 28 | 11 | 3 | -3 | -8 | 5 | 0 | -12 |
| | | 5 | 19 | 41 | 15 | 6 | 0 | -6 | 8 | -1 | -12 |
| | | 6 | 34 | 49 | 23 | 2 | -2 | -7 | 6 | 1 | -6 |
| | | 7 | 56 | 57 | 27 | 7 | 2 | -7 | 8 | 5 | -2 |
| | | 8 | 70 | 67 | 26 | 13 | 6 | -10 | 10 | 9 | -1 |
| | | 9 | 81 | 70 | 30 | 9 | 3 | -12 | 8 | 6 | -5 |
| | | 10 | 82 | 62 | 19 | 12 | -2 | -21 | 8 | 4 | -9 |
| | TE | 11 | 81 | 54 | 14 | 16 | -1 | -29 | 11 | 5 | -10 |
| | | 12 | 66 | 42 | 17 | 16 | -6 | -34 | 14 | 3 | -15 |
| C. Limit | | | 100 | | | 100 | | | | | |
| Spec | | | 150 | | | 150 | | | | | |

HMR_AvPerPoint

Figure 13B

Separation View, Dress and Jacket Page

| Horizontal Shift Yellow separation view | | | | | | | |
|---|---|---|---|---|---|---|---|
| | Real Shift Max (L,R) | C.limit | SPEC | | Dress max gap | C.limit | SPEC |
| Simplex | -83 | 150 | 200 | | 82 | 250 | 350 |
| Duplex | 85 | 150 | 200 | | 72 | 250 | 350 |

141

| Vertical Shift Yellow separation view | | | | | | | | | |
|---|---|---|---|---|---|---|---|---|---|
| | Real shift Max | C.limit | SPEC | Real Shift Range | C.limit | SPEC | Jacket max gap | C.limit | SPEC |
| Simplex | 4 | 150 | 200 | 77 | 100 | 150 | 73 | 100 | 250 |
| Duplex | 78 | 150 | 200 | 142 | 100 | 150 | 48 | 100 | 250 |

142

| Vertical Shift Magenta separation view | | | | | | |
|---|---|---|---|---|---|---|
| | Real shift Max | C.limit | SPEC | Real Shift Range | C.limit | SPEC |
| Simplex | 57 | 150 | 200 | 44 | 100 | 150 |
| Duplex | 58 | 150 | 200 | 45 | 100 | 150 |

143

| Vertical Shift Cyan separation view | | | | | | |
|---|---|---|---|---|---|---|
| | Real shift Max | C.limit | SPEC | Real Shift Range | C.limit | SPEC |
| Simplex | -3 | 150 | 200 | 51 | 100 | 150 |
| Duplex | 14 | 150 | 200 | 54 | 100 | 150 |

144

Figure 14

Theta Parameters Page
(1)

Theta Percentage Values – all pages and all colors

151

| | | Theta results % | | | | |
|---|---|---|---|---|---|---|
| Page side | Page | K | Y | M | C.limit | SPEC |
| Simplex | Page1 W | 100% | 97% | 100% | | |
| | Page2 C | 100% | 99% | 100% | 85% | 80% |
| | Page3 M | 100% | 100% | 100% | | |
| | Page4 K | 100% | 100% | 100% | | |
| | Average Simplex | 100% | 99% | 100% | | |
| Duplex | Page5 W | 100% | 82% | 100% | | |
| | Page6 C | 96% | 85% | 100% | | |
| | Page7 M | 100% | 75% | 100% | | |
| | Page8 K | 100% | 85% | 100% | | |
| | Average Duplex | 99% | 82% | 100% | | |
| Average | Average ALL | 99% | 91% | 100% | | |

Frequencies Table

152

| Magenta | | Black | | |
|---|---|---|---|---|
| Amplitude | Freq. Hz | Amplitude | C.Limit | Spec |
| 2.78 | 10.3 | 1.13 | 4 | 6 |
| 0.53 | 20.6 | 1.44 | 4 | 6 |
| 0.23 | 30.9 | 1.18 | 4 | 6 |
| 0.51 | 41.2 | 0.88 | 4 | 6 |
| 2.55 | 17 | 3.29 | 6 | 7 |
| 1.93 | 12 | 2.04 | | |
| 2.81 | 13 | 2.67 | | |
| 2.54 | 14 | 3.11 | | |
| 2.01 | 16 | 3.41 | | |
| 2.61 | 19 | 2.51 | | |
| 1.89 | 7 | 1.91 | | |
| 2.19 | 20 | 1.86 | | |
| 2.67 | 18 | 2.99 | | |
| 2.82 | 15 | 3.35 | | |

Figure 15A

Theta Parameters Page
(2)

153

Theta polynomial fitting – all pages, M and K colors only

| | | f = a0 | | f = a0 + a1 X | | | f = a0 + a1 X + a2 X^2 | | | | f = a0 + a1 X + a2 X^2 | | | | |
|---|---|---|---|---|---|---|---|---|---|---|---|---|---|---|---|
| Color | Page | a0 | R^2 | a0 | a1 | R^2 | a0 | a1 | a2 | R^2 | a0 | a1 | a2 | a3 | R^2 |
| Magenta | 1 | 8.37 | 1 | 7.15 | 0.01 | 0.98 | 12.3 | -0.06 | 0 | 0.82 | 6.6 | 0.07 | -0 | 0 | 0.7 |
| | 2 | 8.47 | 1 | 9.64 | -0.01 | 0.98 | 13.1 | -0.05 | 0 | 0.89 | 8.77 | 0.05 | -0 | 0 | 0.82 |
| | 3 | 12.5 | 1 | 14.9 | -0.01 | 0.94 | 18.9 | -0.06 | 0 | 0.86 | 9.09 | 0.17 | -0 | 0 | 0.61 |
| | 4 | 12 | 1 | 12.3 | -0 | 1 | 16.7 | -0.06 | 0 | 0.89 | 6.8 | 0.17 | -0 | 0 | 0.59 |
| | 5 | 32.1 | 1 | 28.7 | 0.01 | 0.9 | 28.4 | 0.02 | -0 | 0.9 | 15.7 | 0.31 | -0 | 0 | 0.52 |
| | 6 | 31.9 | 1 | 31 | 0 | 0.99 | 30.1 | 0.01 | -0 | 0.99 | 17.4 | 0.31 | -0 | 0 | 0.51 |
| | 7 | 33.8 | 1 | 27.1 | 0.03 | 0.64 | 24.1 | 0.07 | -0 | 0.6 | 12.2 | 0.34 | -0 | 0 | 0.3 |
| | 8 | 37.6 | 1 | 33.4 | 0.02 | 0.81 | 29.2 | 0.07 | -0 | 0.72 | 16.9 | 0.36 | -0 | 0 | 0.29 |
| Black | 1 | 1.11 | 1 | 5.93 | -0.02 | 0.8 | 4.47 | -0 | -0 | 0.79 | -9.06 | 0.31 | -0 | 0 | 0.36 |
| | 2 | -4.13 | 1 | 0.76 | -0.02 | 0.78 | 0.89 | -0.02 | 0 | 0.78 | -10.6 | 0.25 | -0 | 0 | 0.45 |
| | 3 | -5.44 | 1 | 2.07 | -0.03 | 0.65 | 1.45 | -0.02 | -0 | 0.64 | -12.9 | 0.31 | -0 | 0 | 0.3 |
| | 4 | -3.72 | 1 | 1.74 | -0.02 | 0.79 | 0.97 | -0.01 | -0 | 0.79 | -15.8 | 0.38 | -0 | 0 | 0.26 |
| | 5 | -20.3 | 1 | -15.4 | -0.02 | 0.84 | -6.04 | -0.14 | 0 | 0.57 | -13.1 | 0.03 | -0 | 0 | 0.48 |
| | 6 | -24.9 | 1 | -9.95 | -0.06 | 0.46 | 3.76 | -0.24 | 0 | 0.24 | -4.4 | -0.05 | -0 | 0 | 0.19 |
| | 7 | -21.3 | 1 | -12 | -0.04 | 0.62 | -1.86 | -0.17 | 0 | 0.4 | -11.8 | 0.06 | -0 | 0 | 0.29 |
| | 8 | -18.3 | 1 | -6.27 | -0.05 | 0.54 | 5.18 | -0.2 | 0 | 0.33 | -8.21 | 0.12 | -0 | 0 | 0.18 |

Figure 15B

Theta Parameters Page

(3)

METHOD AND APPARATUS FOR ASSESSING THE OPERATION OF A COLOR PRINTING SYSTEM

BACKGROUND

Most commercial color printing uses three or four subtractive primary colour inks, typically: Cyan (C), Magenta (M), Yellow (Y) and usually also Black (K). A color image to be printed is first separated into a respective primary-color image (color separation) for each ink and these images are then printed as superimposed layers (color planes), using a halftoning process.

In order to keep consistent colors within a page and among pages, printing devices need to maintain consistent registration among the color planes. Registration changes can also lead to the appearance of moiré and banding artefacts. Registration changes may arise for a variety of reasons such as mechanical, optical and electrical features of the printer, mechanical shocks, deformations of the printing substrate (typically paper), etc.

Various techniques are known for monitoring color plane registration (CPR) the most common of which is to print a CPR test page with both nominally-aligned horizontal lines and nominally-aligned vertical lines in each of the inks being used (as used herein in relation to color plane registration, the term "vertical" means the direction of process flow through the printing system whereas "horizontal" means the direction transverse to the process flow). The printed test page is then imaged to form a digital image from which the out-of-alignment distances between the different-colored lines are measured. Typically, the lines of one color (usually black) are used as a reference and the distance of each of the other lines from the black is then measured to give mis-registration values in both the vertical and horizontal directions.

CPR test pages are used, for example, during initial set up of a printing system; they are also used in diagnostic processes where, following detection of imperfections in printed jobs, various different tests are carried out using test-specific test pages, to identify the printing system fault giving rise to the detected imperfections.

BRIEF DESCRIPTION OF THE DRAWINGS

Embodiments of the invention will now be described, by way of non-limiting example, with reference to the accompanying diagrammatic drawings, in which:

FIG. 5 depicts example database Tables 1-4, generated by a corresponding sub-step of FIG. 4, for storing basic CPR parameter values;

FIG. 6 depicts example database Tables 5-8 generated by a corresponding sub-step of FIG. 4, for storing Yellow Validation parameter values;

FIG. 7A depicts example database Tables 9-11 generated by a corresponding sub-step of FIG. 4, for storing Shift parameter values;

FIG. 7B depicts example database Tables 12-15 generated by a corresponding sub-step of FIG. 4, for storing After-Shift parameter values;

FIGS. 8A, Bdepict example database Tables 16-21 generated by a corresponding sub-step of FIG. 4, for storing theta-related parameter values;

FIG. 10 is a list of Spec and C_limit thresholds used during the FIG. 9 MR analysis and report generation step;

FIG. 11 shows an example "Main" report page generated by the FIG. 9 MR analysis and report generation step;

FIGS. 12A, B, C show an example "Full CMR" report page generated by the FIG. 9 MR analysis and report generation step;

FIGS. 13A, B show an example "Random Point Range" report page generated by the FIG. 9 MR analysis and report generation step;

FIG. 14 shows an example "Separation View Dress & Jacket" report page generated by the FIG. 9 MR analysis and report generation step.

DETAILED DESCRIPTION

Figure 1:
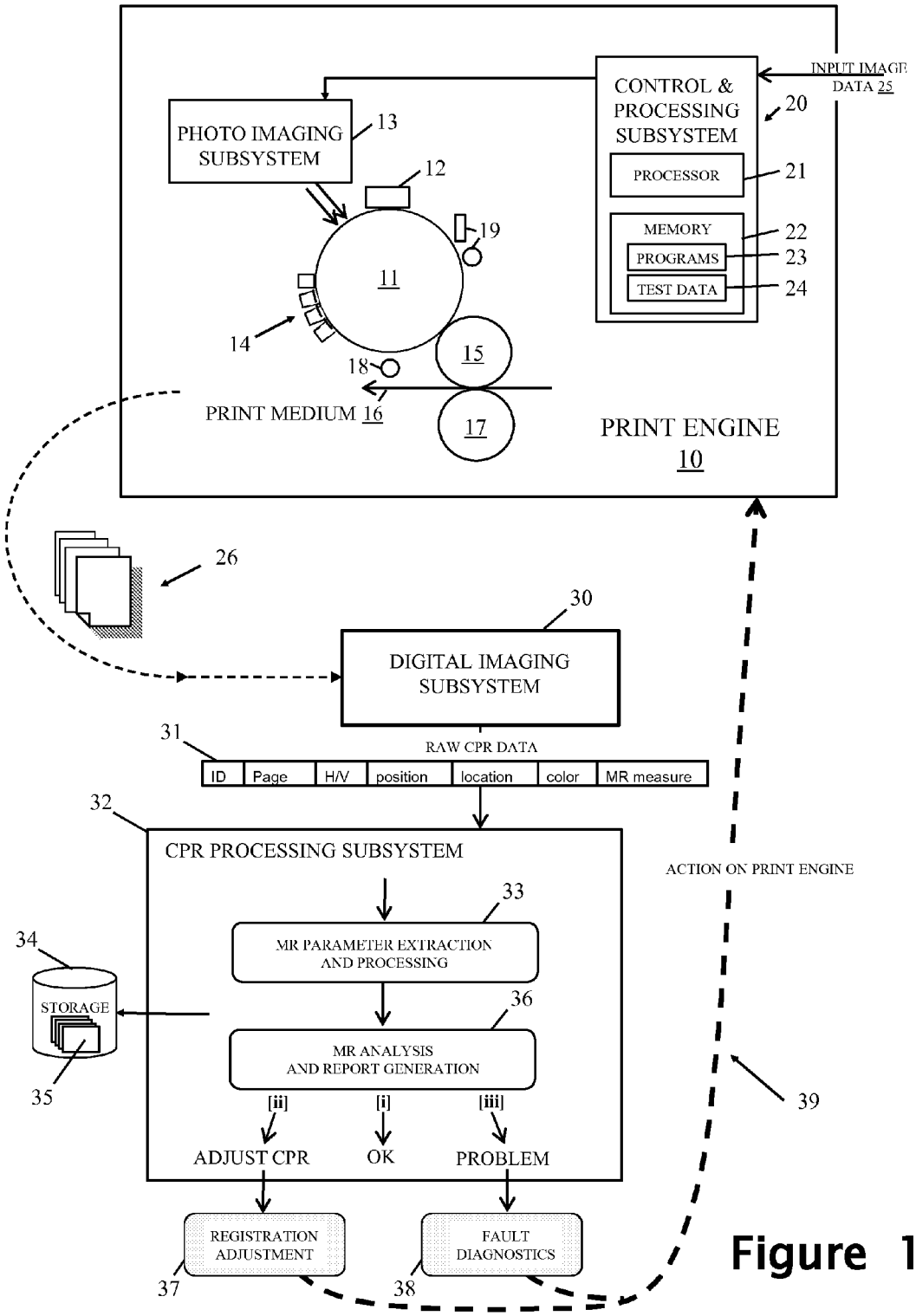
FIG. 1 is a diagram depicting the execution of an example CPR test method embodying the invention, on a known form of electro-photographic printing system.

FIG. 1 depicts an example embodiment of the present invention in which CPR measurements are used to monitor the operation of a printing system. In the FIG. 1 example, the printing system being monitored comprises a known form of liquid electrostatic printing (LEP) print engine 10; it is, however, to be understood that embodiments of the present invention can be used to evaluate the output of any type of printing system (including inkjet printers as well as laser printers).

The LEP print engine 10 shown in FIG. 1 is arranged to print color images using four marking agents (inks), for example: cyan, magenta, yellow and black inks Each ink, here in the form of a liquid toner, is printed in turn in a respective operating cycle in which a uniform electrostatic charge is first applied, by a charge roller or other suitable charging device 12, to a photoconductive drum 11 (for example, formed by a thin film of photoconductive material, commonly referred to as a photo imaging plate (PIP), wrapped around the outer surface of a cylindrical body). After the drum has been fully charged, a photo imaging sub-system 13 exposes selected areas of the photoconductive drum 11 to light in the pattern of the desired printed image for the ink to be printed thereby dissipating the charge on the areas exposed to the light. In discharge area development (DAD), for example, the discharged areas on the drum 11 form an electrostatic image which corresponds to the image to be printed. This electrostatic image is said to be a "latent" image because it has not yet been developed into a toner image. A thin layer of liquid toner is then applied to the drum 11 using a developer unit 14, commonly referred to as a binary ink developer (BID), that supplies ink to a small roller that rotates against drum 11. There is a respective developer unit 14 for each ink.

The latent image on the drum 11 is developed through the application of the liquid toner which adheres to the discharged areas of the drum 11 in a uniform layer developing the latent electrostatic image into a toner image. The toner image is transferred from the drum 11 to an intermediate transfer roller 15 and then from the intermediate transfer roller 15 to a print medium 16 as the latter passes through a nip between the roller 15 and a pressure roller 17. Print medium 16 represents generally any suitable print medium and may be delivered to print engine 10 as a continuous web dispensed from a roll or as individual sheets. An LED lamp or other suitable discharging device 18 removes residual charge from the drum 11 and toner residue is removed at a cleaning station 19 in preparation for developing the next image or for applying the next toner color plane.

The print engine 10 is controlled by a control and processing subsystem 20 that typically takes the form of a program controlled processor 21, and associated computer-readable storage medium (memory) 22 comprising both volatile and non-volatile sections. The memory 22 stores a set of programs 23 for causing the processor 21 to control the operation of the printing engine 10 and to carry out processing such as initial color management processing and halftone processing of input image data 25 to derive signals for controlling the photo imaging sub-system 13. The memory 22 also serves as a temporary store for intermediate processing results. It will be appreciated that the control and processing subsystem 20 may take other forms such as dedicated hardware (for example an ASIC or suitable programmed field programmable array).

As already noted, maintaining consistent registration among the color planes is important for a number of reasons, including for color consistency and the avoidance of moiré and banding artefacts; as a consequence, color plane registration (CPR) is often monitored to enable gross mis-registration to be corrected. Since registration can be affected by a variety of printer problems, careful analysis of monitored CPR values can aid the identification of such problems.

Accordingly, in the present example embodiment, in order to facilitate assessment of the operation of the printing system comprising the print engine 10, the print engine 10 is caused to print a test job in accordance with CPR test image data 24 (for example, held in memory 22 or externally supplied). In the current example embodiment the test print job comprises a set of four test sheets 26 giving four test pages where the print engine 10 is part of a simplex printing system, or eight test pages where the print engine 10 is part of a duplex printing system printing on both the front and back of each sheet (as used herein in relation to printed media, the term 'page' means a printed side of a media sheet). Regarding the use of the terms 'simplex' and 'duplex' herein, it should be noted that when referring to the test pages, 'simplex pages' is used to refer to the pages constituted by the front of the printed sheets and 'duplex pages' to pages constituted by the rear of the printed sheets. Rather than the duplex test pages being printed as the rear of the sheets whose printed fronts form the simplex test pages, it would alternatively be possible to print the simplex test pages as the front of four sheets and the duplex test pages as the rear of a further four sheets (in this case, the rear of the sheets printed with the simplex test pages and the front of the sheets printed with the duplex test pages will generally be printed with an arbitrary image).

Figure 2:
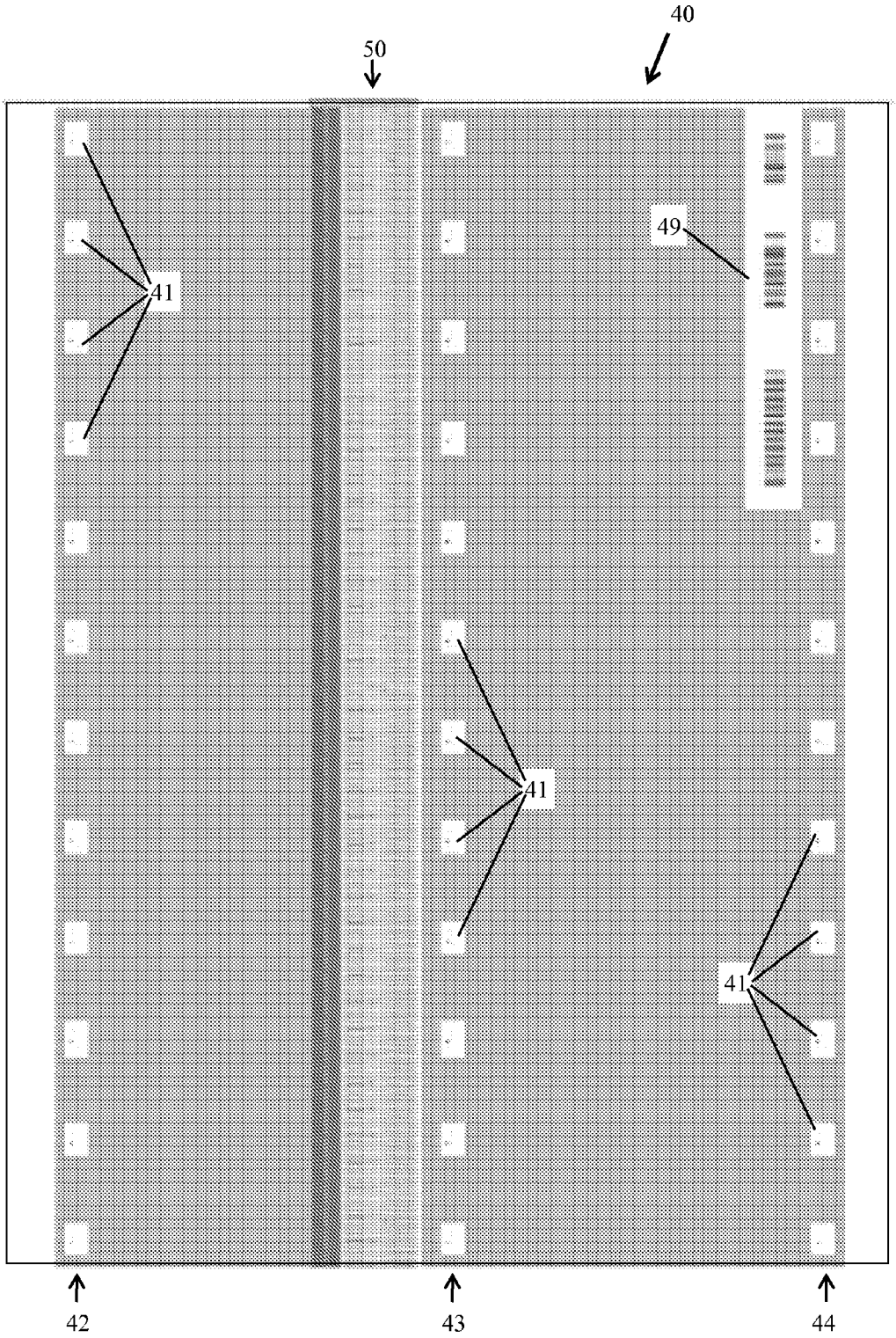
FIG. 2 is a diagram of one page of a CPR test job, printed in the course of the FIG. 1 example method, showing CPR test points and theta markings.

The form of the test pages will be described in more detail later on with reference to FIG. 2 but basically each page has both a plurality of CPR test points distributed over the page (with each test point comprising horizontal and vertical CPR test markings), and a vertical series of test markings for 'theta' measurement (as used herein 'theta' refers to a parameter that describes vertical mis-registration behaviour over the full vertical extent of a page; the test marking related to theta measurement are herein called "theta markings").

Once printed, the test pages 26 are passed to a digital imaging subsystem 30 (for example, a scanner or CCD device) that may either be integrated into the print engine 10 or be a completely separate system. The digital imaging subsystem 30 is arranged to process the digital images of the test pages and to determine from these images horizontal and vertical mis-registration (MR) values for each of the color planes C, M, and Y at each test point and along the series of theta markings (the black color plane being taken as a reference) These MR values are output as raw CPR data 31 for further processing either directly or via the intermediary of a data store. As will be more fully explained below, the raw CPR data 31 provides for each MR value, a set of identifying coordinates in terms of ID, Page, H/V, Position Location and Color. The subsystem 30 may be a distributed form with the MR values being determined from the digital images remotely from where the images are generated.

Processing of the raw data 31 is carried out in CPR processing subsystem 32 which, for example, is a standard computer running appropriate processing software; the processing subsystem may alternatively be implemented as part of the print-engine control and processing subsystem 20.

The CPR processing subsystem 32 is arranged to carry out an initial processing step 33 in which it extracts basic mis-registration parameters from the raw data 31 and derives various other related parameters that are used in subsequent processing steps. These extracted and derived parameters (generically referred to herein as 'mis-registration parameters') can conveniently be organised into database tables 34 and stored in a storage device 35 for access by the next processing step 36; alternatively, the extracted and derived parameters can be output from step 34 directly to the processing step 36.

The processing step 36 is an analysis step in which the mis-registration parameters are analysed to determine one of the following outcomes:

[i] Registration is OK—no action needed;

[ii] Mis-Registration is present but can be reduced by registration adjustments on the print engine 10;

[iii] Substantial Mis-Registration is present and indicative of a problem requiring more than registration adjustment on the print engine.

Where outcome [ii] is determined, appropriate print-engine registration adjustment is carried out (step 37 and dashed arrow 39) either automatically or under the control of an operator.

Where outcome [iii] is determined, fault diagnostics step 38 is carried out to identify the potential print-engine problem and enable appropriate corrective action to be taken (dashed arrow 39). Fault diagnosis can be carried out automatically (for example, using an expert system) or under the control of a service engineer (and potentially with the help of an advisory expert system).

The analysis step 36 can report the determined outcome through a printed report or through a user interface of the CPR processing subsystem 32; in either case, the report can include both a summary of the main results of the analysis and more detailed information on critical mis-registration parameter values.

More generally, the analysis results produced by step 36 can be used to produce output signals for one or more of the following:

a report on mis-registration parameters;

human-controlled/automatic color plane registration adjustment of the print engine;

human-controlled/automatic fault diagnosis (and correction) of the print engine.

The CPR processing subsystem 32 can be distributed over multiple computing entities; in one implementation the MR parameter extraction and processing step 33 is carried out by one computer and the extracted and derived parameters stored in the tables 35 held in a network drive (storage 34), and a second computer is subsequently used to access the tables 35 and carry out the processing step 36.

A more detailed description of the FIG. 1 embodiment will now be given starting with the form of the test pages. As already noted, there are four test pages in the case of simplex printing (printing on front side F of each media sheet) and eight test pages in the case of duplex printing (printing on both the front side F, and back side B of each media sheet). As depicted in FIG. 2, each test page 40 is printed with respective general background color, namely a respective one of white (no color), 100% cy an, 100% magenta, and black (100% all colors); each test page 40 is also printed with an identifying bar code 49 unique to the current CPR test.

Each page 40 is also printed with a plurality of CPR test points 41 (localized areas) distributed over the page in three columns 42, 43, 44 positioned in the left edge region, the centre, and the right edge region respectively of the test page with twelve test points spaced down each column (giving twelve rows each of three test points). Each test point on a page can thus be identified by its position across the page (left, right or center) and its location down the page (one of twelve possible locations). The test points in the two rows nearest the page leading edge are referred to as the leading edge (LE) test points, those of the middle eight rows as the middle test points, and those of the last two rows as the trailing edge (TE) test points.

Figure 3:
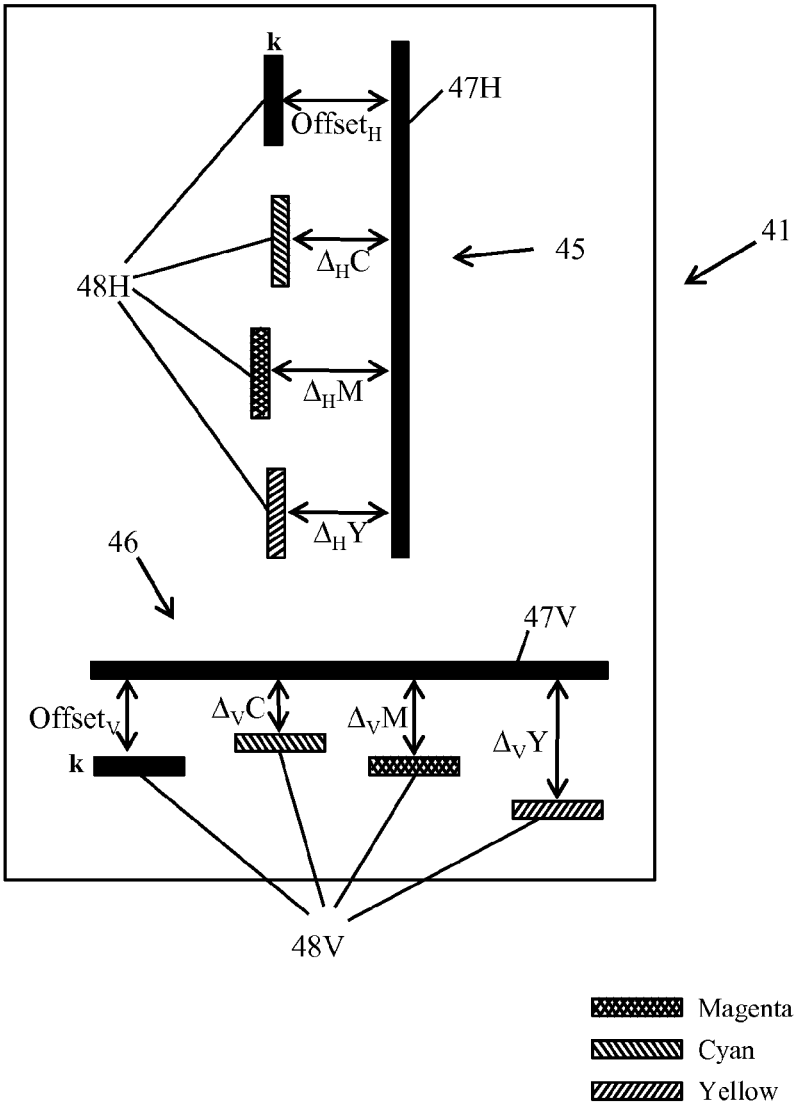
FIG. 3 is a diagram of a test point 41 of the FIG. 2 test page showing horizontal and vertical CPR test markings for measuring horizontal and vertical mis-registration (MR) values.

As shown in detail in FIG. 3, each test point 41 comprises horizontal and vertical CPR test markings 45, 46 for measuring horizontal and vertical mis-registration (MR) values for each color C, Y, M relative to black K. The horizontal CPR test markings 45 comprise a vertically-oriented black reference line 47H and a set 48H of vertically-oriented color lines (one for each color C, Y, M, K) each nominally offset by the same fixed amount to one side of the reference line 47H. In a similar manner, the vertical CPR test markings 46 comprise a horizontally-oriented black reference line 47V and a set 48V of horizontally-oriented color lines (one for each color C, Y, M, K) each nominally offset by the same fixed amount below the reference line 47V.

In addition to the test points 41, each test page 40 is printed with a vertical series 50 of 434 theta test markings spaced at 1 mm vertical intervals and each of the same form as the CPR test marking 46 for measuring vertical MR values.

In the digital imaging subsystem 30, after a printed set of test pages has been digitally imaged, for each test marking 45 and 46 of the test points 41 and for each theta test marking of the vertical series 50, the distance between each color line in the set of color lines 48V/H and the corresponding reference line 47V/H is measured to produce a Δ value:

Distance between K line and reference: $\Delta_{V/H}K$

Distance between C line and reference: $\Delta_{V/H}C$

Distance between M line and reference: $\Delta_{V/H}M$

Distance between Y line and reference: $\Delta_{V/H}Y$ the suffix V or H indicating whether the measured value relates to Vertical or Horizontal registration. The value between the black line in the set of color lines 48V/H and the reference line 47V/H is taken as the value of the nominal offset $Offset_{V/H}$ between the color lines and the reference line 47 and the mis-registration value MR between each of the color line C, M, Y and the black line K is then computed as:

Cyan horizontal mis-registration $C_MR_H=\Delta_H C-Offset_H$

Magenta horizontal mis-registration $M_MR_H=\Delta_H M-Offset_H$

Yellow horizontal mis-registration $Y_MR_H=\Delta_H Y-Offset_H$

Cyan vertical mis-registration $C_MR_V=\Delta_V C-Offset_V$

Magenta vertical mis-registration $M_MR_V=\Delta_V M-Offset_V$

Yellow vertical mis-registration $Y_MR_V=\Delta_V Y-Offset_V$

These computed MR values form the values included in the raw data 31 (see FIG. 1). Each MR value in the raw data is identified by a unique combination of the following coordinate parameters:

ID The unique test identifier encoded in the bar code 49;

Page Test sheet number and front/back indicator;

H/V whether the MR measure concerns horizontal or vertical registration;

Position The position (Left, Center, Right across the current page) where the MR measure relates to a test point 41, or an indication that the MR measure concerns the theta test markings 50;

Location The vertical location of the test point (one of twelve down the current page where the MR measure relates to a test point 41, or one of 434 locations in the theta test marking series 50 where the MR measure relates to the latter);

Color The color {Y, M, C} to which the measure relates.

Since, for the duplex case, there are 288 test points 41 (8 pages, 36 test points per page) and six MR values per test point (H and V values for each color Y, M, C), the raw data 31 comprises 1728 test-point MR values. In addition, the raw data 31 includes (again, for the duplex case) 10416 theta-related MR values (8 pages, 434 theta markings in each vertical series 50, and three colors). The raw data 31 thus contains 12144 MR values organized, for example, in respective rows of the form shown in FIG. 1 of a comma-delimited CSV file.

Parameter Extraction and Processing Step 33

Figure 4:
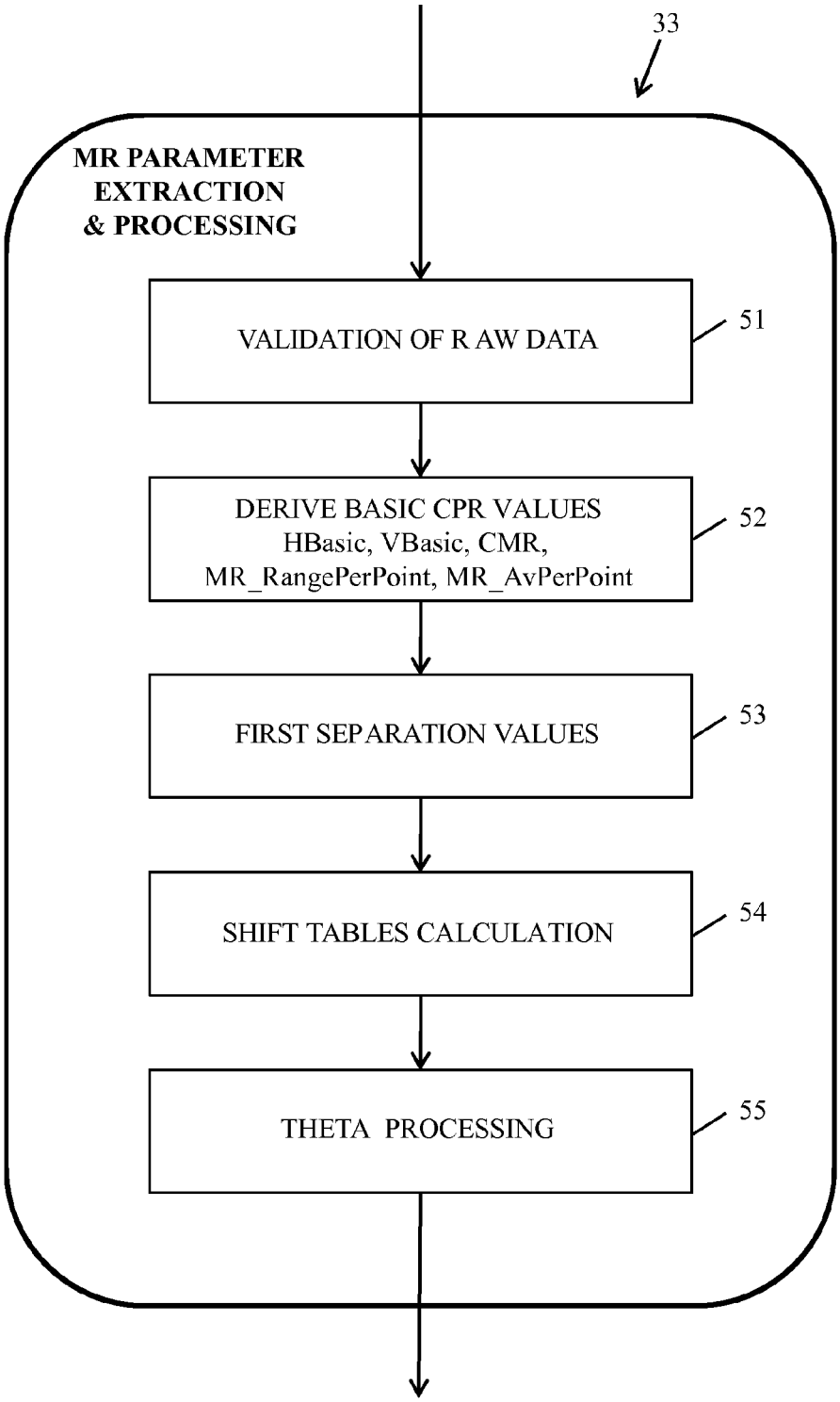
FIG. 4 is a flow chart showing the component sub-steps of a MR parameter extraction and processing step of the FIG. 1 example method.

In due course the raw data 31 is accessed by the CPR processing subsystem 32 where the previously-mentioned initial MR parameter extraction and processing step 33 is carried out. As depicted in FIG. 4, step 33 comprises five sub-steps 51 to 55. Sub-step 51 validates the raw data by checking that the expected number of MR values and their associated coordinates are present and within validity limits. Sub-steps 52-55 involve the derivation of CPR-related parameters and in the present example embodiment, the parameter values derived in each sub-step 51 to 55 are output in the form of one or more database tables 35 stored to the network storage 34. The form and content of these tables are illustrated in FIGS. 5 to 8 through the depiction of example rows. In these example rows, the right hand row cell(s)—with legend(s) in bold italics—contain(s) the newly-derived parameter value(s); the remaining row cells are the identifying coordinates for the derived value(s) in terms of page/position/location/color/etc., as appropriate. It will be appreciated that the use of database tables to store the parameter values is only one of many possible ways of making these values available for subsequent use.

Sub-Step 52

In the sub-step 52, basic CPR parameter values are derived and stored to Tables 1 to 4 illustrated in FIG. 5. More particularly, taking each table in turn:

Table 1—Basic MR Values

The basic H and V MR values ($Y_MR_H$, $M_MR_H$, $C_MR_H$, and $Y_MR_V$, $M_MR_V$, $C_MR_V$,) for the test points 41 are extracted from the raw data 31 and stored to Table 1 along with their associated coordinate data—Table 1 is formed as two sub-tables, one for the basic H MR values (hereinafter called the 'HBasic' values) and one for the V MR values (hereinafter called the 'VBasic' values). Each sub-table comprises 864 rows (3 color×288 test points per color).

Table 2—Color-to-Color MR Maximum Values

For each test point 41, the maximum of the H and V color-to-color MR values (herein called CMR values) are derived:

$$MR=\max(|Y_MR|, |M_MR|, |C_MR|, |Y_MR-M_MR|, |Y_MR-C_MR|, |M_MR-C_MR|)$$

The CMR values are stored to Table 2 along with the coordinate data of the associated test points—Table 2 is formed as four sub-tables, one each for the simplex H CMR values, the simplex V CMR values, the duplex H CMR values and the duplex V CMR values (in this context and in similar contexts below, 'simplex' is being used to refer to the front of the printed sheets and 'duplex' to the rear of the printed sheets). Each sub-table comprises 144 rows (4 pages×36 test points per page).

Table 3—MR Range Per Point

For each color Y, M, C, the ranges of H and V MR values at corresponding test points 41 on the simplex/duplex pages are computed:

$$MR_RangePerPoint=Max_{4_page}(H\text{Basic}/V\text{Basic})-Min_{4_pages}(H\text{Basic}/V\text{Basic})$$

The MR_RangePerPoint values are stored to Table 3 along with the coordinate data identifying which of the thirty-six test points on a page is involved—Table 3 is formed as four sub-tables, one each for the simplex H MR_RangePerPoint values ('SHMR_RangePerPoint' values), the simplex V MR_RangePerPoint values ('SVMR_RangePerPoint' values), the duplex H MR_RangePerPoint values ('DHMR_RangePerPoint' values) and the duplex V MR_RangePerPoint values ('DVMR_RangePerPoint' values). Each sub-table comprises 108 rows (3 colors×36 test points per color).

Table 4 MR_Av. Per Point

For each color Y, M, C, average H and V MR values ('MR_AvPerPoint' values) are computed across the simplex/duplex pages for the corresponding test points 41 on these pages as:

$$MR_AvPerPoint=(Max_{4_page}(H\text{Basic}/V\text{Basic})+Min_{4_pages}(H\text{Basic}/V\text{Basic}))/2$$

(Note that is an average of the maximum and minimum MR values rather than an average across all MR values). The MR_AvPerPoint values are stored to Table 4 along with the coordinate data identifying which of the thirty-six test points on a page is involved—Table 4 is formed as four sub-tables, one each for the simplex H MR_AvPerPoint values ('SHMR_AvPerPoint' values), the simplex V MR_AvPerPoint values ('SVMR_AvPerPoint' values), the duplex H MR_AvPerPoint values ('DHMR_AvPerPoint' values) and the duplex V MR_AvPerPoint values ('DVMR_AvPerPoint' values). Each sub-table comprising 108 rows (3 colors×36 test points per color).

Sub-Step 53

In the sub-step 53, MR-related parameters are derived concerning the first separation to be printed (in the present example, Yellow). Certain faults or incorrect adjustments of the print engine 10 (for example, print-media transport operation faults) principally affect the mis-registration behaviour of the first separation and can be detected by examining certain specific MR-related parameters. In the present example embodiment two such parameters (and related maximum values) are derived, these parameters being respectively referred to herein as "Dress" (related to Horizontal mis-registration) and Jacket" (related to Vertical mis-registration); the Jacket parameter is represented by a left and right value pair. The values derived in sub-step 53 are stored to Tables 5 to 8 illustrated in FIG. 6. More particularly, taking each table in turn:

Table 5—Dress

For each location (test-point horizontal triple) on each simplex/duplex page, the absolute value of the difference between the H MR values for the Left and Right test points is computed:

$$Dress=ABS(L-R_{12_locations}(\text{yellow}(SH\text{Basic}/DH\text{Basic})))$$

The Dress values are stored to Table 5 along with the coordinate data identifying the page and which of the twelve locations on that page is involved—Table 5 is formed as two sub-tables, one each for the simplex Dress values ('SHDress' values) and the duplex Dress values ('DHDress' values). Each sub-table comprises 48 rows (4 pages×12 locations per page).

Table 6—MaxDress

For each simplex/duplex page, the maximum Dress value is stored to Table 5 as the MaxDress value for that page:

$$MaxDress=\max_{12_locations}(SH\text{Dressc}/DH\text{Dress})$$

Table 5 is formed as two sub-tables, one each for the simplex MaxDress values ('SHMaxDress' values) and the duplex MaxDress values ('DHMaxDress' values). Each sub-table comprises 4 rows (4 pages).

Table 7—Jacket

For each location (test-point horizontal triple) on each simplex/duplex page, the absolute value of the difference between the V MR values for the Left and Center test points is computed as is the absolute value of the difference between the V MR values for the Right and Center test points:

Jacket $$\text{yellow}LC=ABS(L-C_{12_locations}(\text{yellow}(SV\text{Basic}/DV\text{Basic})))$$

$$\text{yellow}RC=ABS(R-C_{12_locations}(\text{yellow}(SV\text{Basic}/DV\text{Basic})))$$

The pair of values 'yellowLC' and 'yellowRC' form the Jacket value (the 'yellow' being specific to the present example where yellow is the first separation). The Jacket values are stored to Table 6 along with the coordinate data identifying the page and which of the twelve locations on that page is involved—Table 6 is formed as two sub-tables, one each for the simplex Jacket values ('SVJacket' values) and the duplex Jacket values ('DHJacket' values). Each sub-table comprises 48 rows (4 pages×12 locations per page).

Table 8—MaxJacket

For each simplex/duplex page, the maximum Jacket value (whether 'yellowLC' or 'yellowRC') for the page is stored to Table 8 as the MaxDress value for that page:

$$MaxJacket=\max_{12_locations}(\text{yellow}LC, \text{yellow}RC)$$

Table 8 is formed as two sub-tables, one each for the simplex MaxJacket values ('SHMaxJacket' values) and the duplex MaxJacket values ('DHMaxJacket' values). Each sub-table comprises 4 rows (4 pages).

Sub-Step 54

The overall objective of sub-step 54 is to be able to predict what improvements are possible in color plane registration by registration adjustment on the printing system. To this end, sub-step 54 first calculates 'shift' values—as used herein, the term 'shift' means a separation-specific offset for adjusting color plane registration relative to the reference separation (K in the present example) so as to generally minimize mis-registration overall (always allowing that applying the shift may actually increase mis-registration in localised areas). After the shift values have been calculated, sub-step 54 proceeds to predict what mis-registration improvements are possible by applying the shift values to the existing MR values.

Registration adjustment of a separation on the printing system 10 will generally involve altering one or more parameters used by the control and processing subsystem 20 in deriving signals for controlling the photo imaging sub-system 13 for the separation concerned. In some printing systems it is possible to directly input desired separation adjustments (for example, in microns) which the control and processing system 20 then implements; in this case, the shift values calculated in sub-step 54 take the form of an overall average of the mis-registration values for each separation. However, other printing systems do not accommodate adjustment of registration by specified amounts but, instead, rely on adjustment 'wizards' to adjust registration (for example, a wizard may require the printing of a special pattern that is analyzed in four places on the left and right of the printed sheet to derive mis-registration values—these values are input into a software wizard which then calculates and implements the required shifts). Where shifts have to be implemented through a wizard, the shift calculation in sub-step 54 needs to take account of the behaviour of the wizard for the printing system concerned (that is, determine what shifts the wizard will implement given the current MR values). For present illustrative purposes, it will be assumed that the printing system can implement requested registration adjustments; however, embodiments in which the computed shift takes account of the transfer function of the printing-system CPR adjustment wizard, are also envisaged. It should also be noted that, as for the example wizard outlined above, a wizard may only use mis-registration values at a few specific points and in such cases the number of values that need to been measured and derived will generally be less than in the present example. Furthermore, a wizard may not provide for the registration adjustment of all separations relative to the reference separation so that the number of values that need to been measured and derived will be further reduced.

The shift values calculated in sub-step 54 are stored to Tables 9 to 11 illustrated in FIG. 7A; the MR predictions calculated in sub-step 54 based on the shift values are stored to Tables 12 to 15 illustrated in FIG. 7B. More particularly, taking each table in turn:

Table 9—Vertical Shifts

For each color Y, M, C, a vertical shift value is calculated as the average of the maximum and minimum VBasic values across all the test points on the simplex/duplex pages:

$$V\text{Shift}=(\text{Max}_{4_page,\ 36_points}(SV\text{Basic}/DV\text{Basic})+\text{Min}_{4_\text{pages},\ \mathbf{36}_points}(SV\text{Basic}/DV\text{Basic}))/2$$

The VShift values are stored to Table 9 along with the coordinate data identifying the color involved—Table 9 is formed as two sub-tables, one each for the simplex VShift values ('SVShift' values), and the duplex VShift values ('DVShift' values). Each sub-table comprises 3 rows, one for each color.

Table 10—Vertical Shift Range

For each color Y, M, C, a vertical MR range value is calculated across all points on the simplex/duplex pages—this value is called the vertical shift range (VShiftRange) to distinguish it from the Range per point values in Table 3.

$$V\text{ShiftRange}=(\text{Max}_{4_page,\ 36_points}(SV\text{Basic}/DV\text{Basic})-\text{Min}_{4_pages,\ 36_points}(SV\text{Basic}/DV\text{Basic}))$$

The VShiftRange values are stored to Table 10 along with the coordinate data identifying the color involved and whether the value is for the simplex or duplex—Table 10 is formed as two sub-tables, one each for the simplex VShiftRange values ('SVShiftRange' values), and the duplex VShiftRange values ('DVShiftRange' values). Each sub-table comprises 3 rows, one for each color.

Table 11—Horizontal Shifts

Horizontal shift vales are calculated for the left and right sides of the simplex/duplex pages. To this end, intermediate left and right values x_l and x_r are first computed as the average of the maximum and minimum left/right HBasic values down the simplex/duplex pages; these intermediate values are then used to calculate the HShift values:

$$x_l=(\text{Max}_{12locations,\ 4\ pages,\ L\ only}(SH\text{Basic}/DH\text{Basic})+\text{Min}_{12locations,\ 4\ pages,\ L\ only}(SH\text{Basic}/DH\text{Basic}))/2$$

$$x_r=(\text{Max}_{12locations,\ 4\ pages,\ R\ only}(SH\text{Basic}/DH\text{Basic})+\text{Min}_{12locations,\ 4\ pages,\ R\ only}(SH\text{Basic}/DH\text{Basic}))/2$$

$$\text{Right } H\text{Shift}=\text{Sign}(x_r)*60*\text{Round}((\text{abs}(xr)+29/500)/60)$$

$$\text{Left } H\text{Shift}=30*\text{Round}(x_l/30+(\text{Sign}(x_l)*0.5))$$

These formulae for the HShift values are specific to the printing system concerned and give the number of 60 micron correction steps required. The determination of appropriate formulae for other printing system will be within the competence of the ordinary skilled person in the art. The HShift values are stored to Table 11 along with the coordinate data identifying the position (Left/Right) involved—Table 11 is formed as two sub-tables, one each for the simplex Horizontal Shift values ('SHShift' values), and the duplex Horizontal Shift values ('DHShift' values). Each sub-table comprises 6 rows (2 positions L, R×3 colors).

Table 12—Vertical Basic After Shift

The measured VBasic values held in Table 1 are adjusted by the color-appropriate simplex/duplex VShift value from Table 9 to predict MR values after adjustment by the shift values:

$$V\text{BasicAfterShift}=V\text{Basic}-SV\text{Shift}/DV\text{Shift}$$

The VBasicAfterShift values are stored to Table 12 along with the appropriate coordinate data—Table 12 comprises 864 rows (8 pages×3 positions×12 locations×3 colors).

Table 13—Vertical CMR After Shift

Maximum-per-point post-shift V CMR values (color-to-color MR values) are derived from the shifted VBasic values of Table 12 on the same basis as the V CMR values of Table 2 were derived from the VBasic values of Table 1. The V CMRAfterShift values are stored to Table 13 along with the appropriate coordinate data—Table 13 is formed as two sub-tables, one each for the simplex V CMRAfterShift values ('SVCMRAfterShift' values), and the duplex V CMRAfter-Shift values ('DCMRAfterShift' values). Each sub-table comprises 144 rows (4 pages×3 positions×12 locations).

Table 14—Horizontal Basic After Shift

The measured HBasic values held in Table 1 are adjusted by the appropriate R/L simplex/duplex HShift value from Table 11 to predict MR values after adjustment by the shift values:

$$H\text{BasicAfterShift}=H\text{Basic}-SH\text{Shift}\backslash DH\text{Shift (L points with L Shift, R points with R Shift)}$$

The HBasicAfterShift values are stored to Table 14 along with the appropriate coordinate data—Table 14 comprises 144 rows (8 pages×3 positions×12 locations×3 colors).

Table 15—Horizontal CMR After Shift

Maximum-per-point post-shift H CMR values (color-to-color MR values) are derived from the shifted HBasic values of Table 14 on the same basis as the H CMR values of Table 2 were derived from the HBasic values of Table 1. The H CMRAfterShift values are stored to Table 15 along with the appropriate coordinate data—Table 15 is formed as two sub-tables, one each for the simplex H CMRAfterShift values ('SHCMRAfterShift' values), and the duplex H CMRAfter-Shift values ('DHCMRAfterShift' values). Each sub-table comprises 144 rows (4 pages×3 positions×12 locations).

Sub-Step 55

The sub-step 55 is concerned with processing the 10416 theta-related MR values in the raw data 31 (434 theta markings in eight vertical series 50, one per page, for three colors). The basic theta value for a color at a particular one of the 434 vertical locations along a page is the vertical mis-registration between Cyan and the color. Cyan is used as the reference because it is the "quietest" separation, being the third to be printed in the current example where the printing order is Y, M, C, K (it will be appreciated that the first and fourth separations are most likely to be disrupted by imperfections in the mechanical operations of the printing system and in particular by media transport effects). Of the basic theta values themselves, the Magenta values are the "quietest" as it is the second separation (and, again, less effected by media transport and similar issues). After deriving the basic theta values have been derived, the sub-step 55 goes on to calculate various theta-related measures and carries out Fourier processing on the M theta values (as the quietest separation).

The basic theta values and related measures derived in sub-step 55 are stored to Tables 16 to 20 illustrated in FIG. 8A; the Fourier processing results are stored to Table 21 illustrated in FIG. 8B. More particularly, taking each table in turn:

Table 16—Theta Values

The basic V MR values ($Y_MR_V$, $M_MR_V$, $C_MR_V$,) for the theta markings of the vertical series 50 41 are extracted from the raw data 31 and used to compute the basic theta values:

$$Y_\text{theta}=Y_\text{MR}_V-C_\text{MR}_V$$

$$M_\text{theta}=M_\text{MR}_V-C_\text{MR}_V$$

$$K_\text{theta}=-(C_\text{MR}_V)$$

These basic theta values are stored to Table 16 along with their associated coordinate data—Table 16 comprises 10416 rows (8 pages×434 test points×3 colors).

Table 17—Average Theta Values

For each color Y, M, K, the average theta value avjTheta along each page is derived:

$$Y_avj\text{Theta}=avj(Y\text{theta}(\text{Theta}))$$

$$M_avj\text{Theta}=avj(M\text{theta}(\text{Theta}))$$

$$K_avj\text{Theta}=avj(K\text{theta}(\text{Theta}))$$

The avjTheta values are stored to Table 17 along with associated coordinate data—Table 17 is formed as two sub-tables, one each for the simplex avjTheta values and the duplex avjTheta values. Each sub-table comprises 12 rows (4 pages×3 colors).

Table 18—Deviation of Theta Values from Average

For each color Y, M, K, the deviation (here called 'theta-Dist') of each theta value ('theta', Table 16) from the average theta value for the same page ('avjTheta', Table 17) is determined:

$$\text{thetaDist}=ABS(\text{theta}-avj\text{Theta})$$

The thetaDist values are stored to Table 18 along with associated coordinate data—Table 18 is formed as two sub-tables, one each for the simplex thetaDist values and the duplex thetaDist values. Each sub-table comprises 5208 rows (4 pages×434 locations×3 colors).

Table 19—Theta Percentage

For each page and each color Y, M, K on that page, the percentage of thetaDist values (Table 18) falling within a predetermined range ±20 microns is determined (this percentage is herein called the 'theta percentage' or '% theta'); the value of 20 microns for the range is an example and the range value can be made smaller or larger as experience dictates. The % theta values are stored to Table 19 along with associated coordinate data—Table 19 is formed as two sub-tables, one each for the simplex % theta values and the duplex % theta values. Each sub-table comprises 12 rows (4 pages×3 colors).

Table 20—Least Squares Polynomial

For each page and each color Y, M and K on that page, a polynomial is fitted to the corresponding theta values of Table 16 using least squares fitting; this is done for polynomials of degree 0-3 and the resultant polynomial data (here called 'LeastSquaresFitting' and comprising the polynomial coefficients a0 to a3 together with the sum of the squares of the residuals $R^2$) are stored to Table 20 along with associated coordinate data. Table 20 is formed as two sub-tables, one each for the simplex LeastSquaresFitting data ('SLeast-SquaresFitting') and the duplex LeastSquaresFitting data ('DLeastSquaresFitting'); each sub-table comprises 48 rows (4 pages×3 colors×orders).

Table 21—Fourier Transform of theta values

Using the theta values from Table 16 for each of the colors Y, M and K on the second page, frequency components of the spatial variation of these theta values are derived using Fourier techniques well understood by persons skilled in the art. In particular, the amplitudes of three hundred specific frequencies are derived for each color Y, M and K, and are stored to Table 21. Table 21 is formed as three sub-tables, one each for the three colors Y, M and K; each sub-table comprises 300 rows one for each of the 300 frequencies considered.

MR Analysis and Report Generation Step 36

The MR parameters that are extracted and derived in step 33 and stored in tables 35 (Tables 1 to 21 described above) , are subsequently accessed and processed by the CPR processing subsystem 32 in analysis step 36. Of course, the processing carried out in step 33 is a form of analysis of the CPR data and the division of analysis between steps 33 and 36 is largely a matter of choice and convenience for the particular context concerned; indeed, steps 33 and 36 can be integrated with each other.

In the current embodiment, in step 36 (illustrated in FIG. 9) the data in the Tables 1 to 21 is examined and used to generate a multi-page report comprising a main, summary, page and a number of detailed supplementary pages. FIGS. 11 to 15 depict example report pages including, in particular, example main page 110 (FIG. 11).

In generating the report, the values of various key data quantities (either directly present in the Tables or derived therefrom) are compared to predetermined threshold values, these key quantities being selected for their potential to indicate specific types of problem with the printing system. Mostly, these key quantities are reported on the main page 110.

The threshold values take two forms, namely, "Spec" threshold values that specify the acceptable operational limits for the quantities concerned, and "C_limit" values that specify warning levels for the quantities concerned. User alerts are generated when these threshold values are exceeded. Generally, the alerts take two forms:

- firstly, a value of concern is highlighted in the relevant report page—for example, the value is presented on an amber background when the C_limit threshold, but not the Spec threshold, is exceeded and on a red background when the Spec threshold is exceeded, and values below the C_limit may be presented on a green background by default (a key showing the cell shading used in the accompanying drawings to represent the cell background colors of red, amber, green is shown in the bottom right-hand corner of FIG. 11);
- secondly, where a value exceeds the Spec threshold (or exceptionally, a C_limit threshold), an Alert message is output indicating that there is a problem, this message optionally, including a reference (for example, a hyperlink or page reference) to the relevant part of a troubleshooting guide; alternatively, the alert message may refer to the relevant supplementary report page for further details.

Table 100 (FIG. 10) gives example threshold values for one type of printing system.

The output of an alert message corresponds to the "Problem" outcome [i ii] shown in FIG. 1 from the analysis step 36. The analysis step 36 also generates and outputs recommended separation shift values and these correspond to the "Adjust CPR" analysis-step outcome [ii] shown in FIG. 1 where they are non-zero and no alert messages have been generated. The absence of any alert message or shift recommendation corresponds to the "OK" analysis-step outcome [i] shown in FIG. 1.

For reasons of clarity, in the following description of the generation of the main and supplementary report pages in step 36, the generation of the main page is described first together with the associated threshold comparison tests. In practice, the processing associated with the generation of the supplementary pages may be carried out first and whenever a result is produced that is also to be reported on the main page, this result is stored for use on the main page; once generation of the supplementary pages is complete, the main page is generated from the stored relevant results of the supplementary pages plus any main-page specific processing that may be required.

Main Page Processing.

Figure 9:
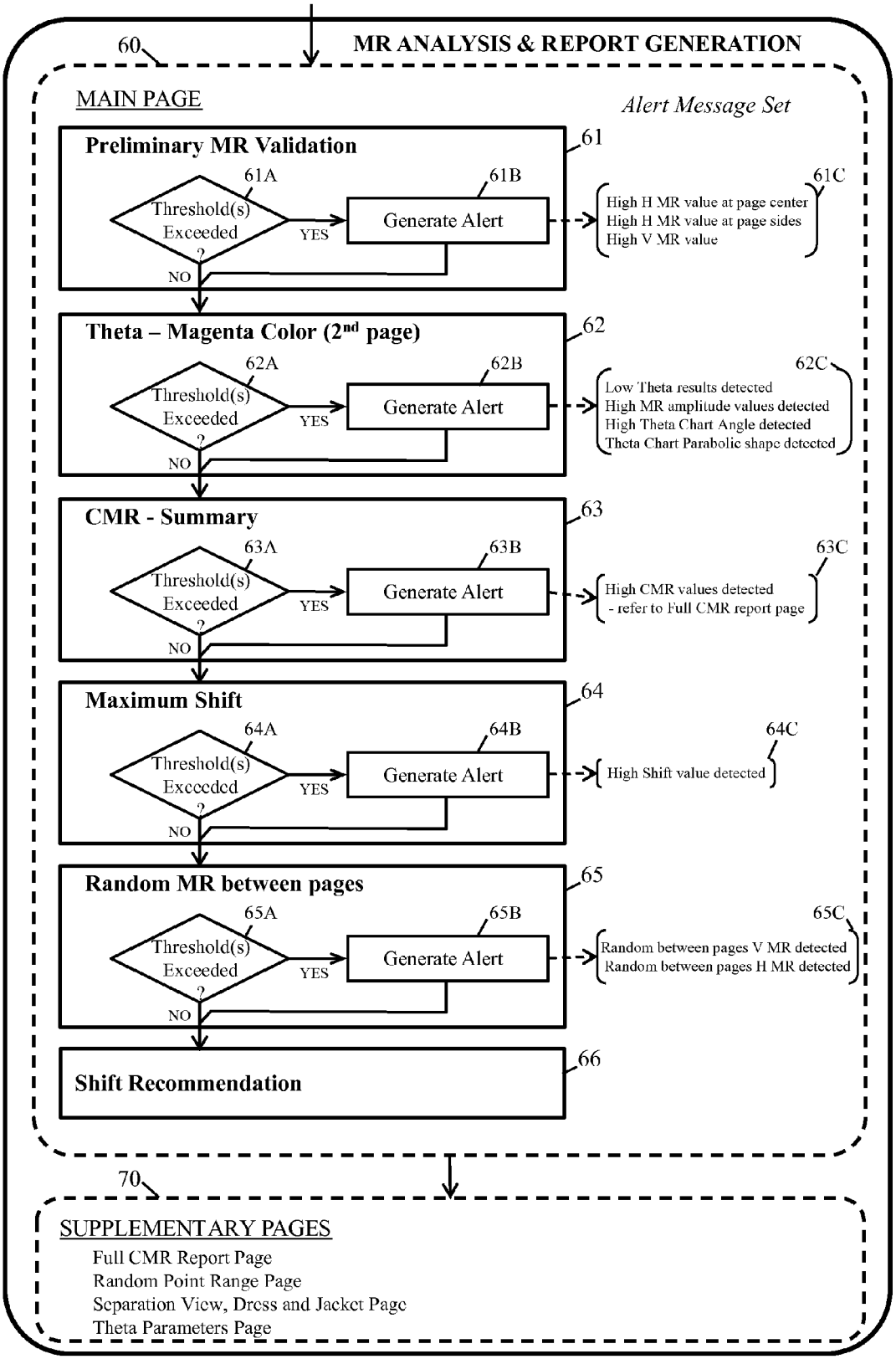
FIG. 9 is a flow chart of a MR analysis and report generation step of the FIG. 1 example method.
Figure 15C:
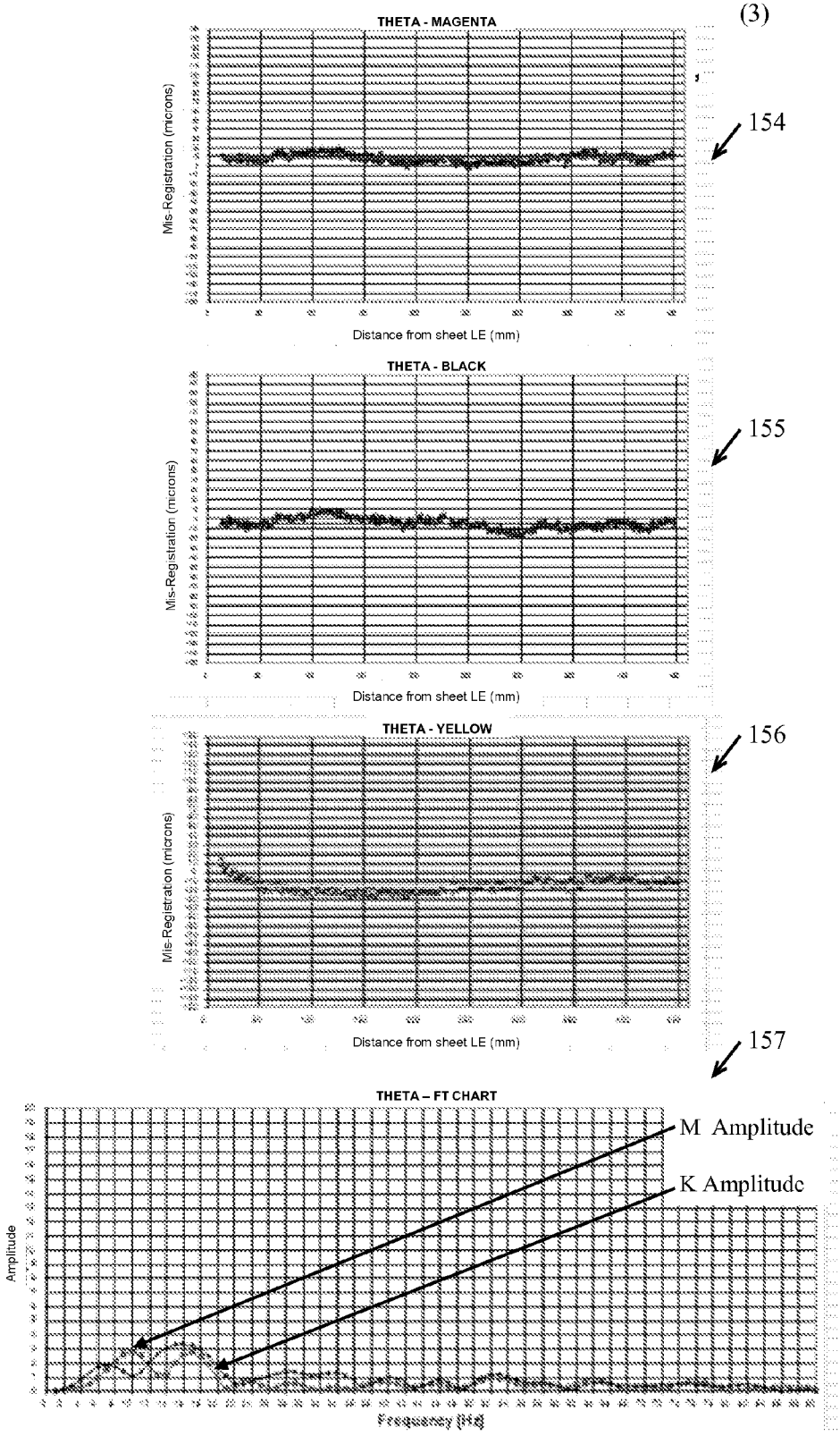
FIGS. 15A, B, C show an example "Theta Parameters" report page generated by the FIG. 9 MR analysis and report generation step.

Referring now to the FIG. 9 depiction of analysis step 36, the main page processing 60 comprises six sub-steps 61-66 as follows:

Sub-Step 61

The sub-step 61 looks at the basic MR values (Hbasic and Vbasic from Table 1) and, in particular, monitors the percentage of MR values exceeding the corresponding C_limit threshold values (there being no Spec thresholds). For the Hbasic MR values, the Left and Right test-point values are looked at separately from the center test-point values; furthermore, for the Left & Right Hbasic MR values, the Y values are considered separately from the C and M values. For each considered set of MR values, the percentage of MR values exceeding the corresponding C_limit threshold values is reported in a respective cell of a Mis-Registration results table (see example table 111 in FIG. 11). Furthermore, for each considered set of MR values, the percentage of values exceeding the corresponding C-limit thresholds is checked (box 61A) and if this percentage is more than 0%, an alert is raised (box 61B) by setting the background of the corresponding result cell to red and outputting an appropriate alert message from the alert message set 61C. In the present case this message set 61C comprises the messages:

High H MR value detected at page center
High H MR value detected at page sides
High V MR value detected In the example results table 111, the percentage value for the central Hbasic set of MR values is shown as 2%, resulting in the background of the corresponding cell being set to red and the output of the alert message 211 "High H MR value detected at page center (Ref: xx)"; the message element "(Ref xx)" is a reference to the relevant part of a troubleshooting guide. For all other considered value sets, the percentage value is 0% resulting in the background of the corresponding cells defaulting to green.

The alert messages "High H MR value detected at page center" and "High H MR value detected at page sides" indicate possible problems with the media (paper) transport subsystem of the printing system concerned. Where the high values are associated with simplex pages (as determined from an inspection of the more detailed MR results provided in the supplementary report pages), the problem is likely to be with the paper transport gripper clamps, feeder guide, or simplex-side buckle; where the high values are associated with duplex pages, the problem is likely to be with the duplex conveyor, suction cups, or duplex-side buckle.

The alert message "High V MR value detected" indicates possible problems with the paper transport, electronics, main drive or photo-imaging subsystem.

Sub-Step 62

The sub-step 62 looks at theta-related values for the M separation, second page, using Tables 19-21 and, in particular, monitors:

- the theta percentage values (Table 19);
- the values of parameters "theta linear fit angle" and "theta parabolic raise" derived from Table 20; and
- the amplitudes of the frequency components (Table 21)

The "theta linear fit angle" is computed, using the value of al from Table 20, as:

$$\text{theta linear fit angle}=\text{arcTan}(a1)$$

and the "theta parabola raise" is computed, using the values of a0, a1, a2 from Table 20, as:

$$\text{theta parabola raise}=a0-(a'-a1)^2/(4*a2)$$

where a'=(y(450)−y(10))/440 and y(x) is the MR value at point x (in mm) along the vertical theta series from the LE.

The theta percentage, linear fit angle and parabolic raise values, are reported in a respective cell of a Theta results table (see example table 112A in FIG. 11); these values are also compared against the corresponding thresholds (box 62A) and alerts are raised (box 62B), as required, by setting the background of the corresponding result cell to red or amber and, where a Spec threshold is crossed, by outputting an appropriate alert message from the alert message set 62C (note that the theta percentage is only a concern if it falls below the corresponding threshold values). Regarding the amplitudes of the frequency component, sub-step 62 only reports (in table 112B) whether or not any amplitude exceeds the corresponding thresholds with the appropriate alert message from message set 62C being output if a Spec threshold is crossed. The message set 62C comprises the messages:

Low Theta results detected

High MR amplitude values detected

High Theta Chart Angle detected

Theta Chart Parabolic shape detected

In the example results tables 112A, B, all values are within their thresholds and so are given against green cell backgrounds and no alert messages are output.

The theta alert messages indicate possible problems with the mechanical sub-systems, electronics or photo-imaging sub-system; in particular, the "High MR amplitude values detected" message indicates possible banding problems and in this case the frequency involved will be a strong indicator of the likely cause, while the "High Theta Chart Angle detected" and "Theta Chart Parabolic shape detected" messages indicate a defect in the PIP drum or its gear assembly.

Sub-Step 63

The sub-step 63 looks at the CMR values (color-to-color per-point-maximum mis-registration values) both before and after theoretical shift application and uses Tables 2, 13, 15; in particular, sub-step 63 monitors:

the maximum before-shift CPM value (the maximum of SHCMR, SVCPM, DHCMR, DVCPM) and the maximum after-shift CPM value (the maximum of SHCMRAfterShift, SVCPMAfterShift, DHCMRAfterShift, DVCPMAfterShift);

the percentages of before-shift and after-shift CMR values exceeding the corresponding C_limit thresholds.

The maximum before-shift and after-shift CPM values and the over-C_limit-threshold percentages, are reported in a respective cell of a CPM-Summary results table (see example table 113 in FIG. 11); these values are also compared against the corresponding thresholds (box 63A) and alerts are raised (box 63B), as required, by setting the background of the corresponding result cell to red or amber and, where a Spec threshold is crossed, by outputting the sole alert message of the alert message set 63C:

High CMR values detected—refer to Full CMR report page, Before/After shift as appropriate.

In the example results table 113, the maximum before-shift CMR value exceeds the corresponding Spec threshold and so is reported with a red cell background and the alert message 213 "High CMR values detected—refer to Full CMR report page" is output; in addition, the maximum after-shift CMR value exceeds the corresponding C_limit threshold and so is reported with an amber cell background.

Sub-Step 64

The sub-step 64 monitors the maximum shift value by determining the maximum absolute value in Tables 10 (SVShiftRange, DVShiftRange) and 11 (SHShifts, DHShifts).

The maximum shift value is reported in a corresponding cell of a Maximum Shift results table (see example table 114 in FIG. 11); this value is also compared against the corresponding thresholds (box 64A) and alerts are raised (box 64B), as required, by setting the background of the result cell to red or amber and, where the Spec threshold is crossed, by outputting the sole alert message of the alert message set 64C:

High Color Shift value detected

The alert message may also refer the user to the relevant supplementary report page (the "Separation View, Dress and Jacket Page" described below).

In the example results tables 114, the maximum shift value is within its thresholds and so is given against a green cell background and no alert message is output.

The maximum-shift alert message indicates possible problems with the dynamic mirror of the photo-imaging subsystem.

Sub-Step 65

The sub-step 65 looks for random MR between pages using Table 3 and, in particular, monitors:

the maximum V MR_RangePerPoint values separately for the Y and for the C and M separations;

the maximum H MR_RangePerPoint values separately for the Y and for the C and M separations.

The maximum MR RangePerPoint values are reported in respective cells of a Random MR Between Pages results table (see example table 115 in FIG. 11); these values are also compared against the corresponding thresholds (box 65A) and alerts are raised (box 65B), as required, by setting the background of the corresponding result cell to red or amber and, where a Spec threshold is crossed, by outputting an appropriate alert message from the alert message set 65C. The message set 65C comprises the messages:

Random between pages V MR detected

Random between pages H MR detected

The alert messages may also refer the user to the relevant supplementary report page (the "Random Point Range Page" described below).

In the example results tables 115 all values are within their thresholds and so are given against green cell backgrounds and no alert messages are output.

Either alert message in respect of the Y separation indicates possible problems with the paper transport; in respect of the C or M separations, the message indicates possible problems with the mechanics (impression and PIP drum bakes, simplex/duplex side paper transport), electronics (master encoder) or the dynamic mirror of the photo-imaging subsystem.

Sub-Step 66

The sub-step 66 reports recommended shift values to be applied to the Y, M, C separations of the printing system (see results table 116—only recommended vertical shifts given in this example as the printing system concerned does not allow for the insertion of horizontal shifts).

The main report page can, of course, report more or less items than described above—for example, high Dress and Jacket values can be reported here.

Supplementary Page Processing.

The supplementary page processing 70 (FIG. 9) involves generating the following report pages containing fuller details of the mis-registration results:

Full CMR Report Page

Random Point Range Page

Separation View, Dress and Jacket Page

Theta Parameters Page

As appropriate, these pages contain the same alerts as reported on the main page; in addition, some pages have report-page-specific alerts (as for the Main page, the alerts are generated in dependence on the comparison of the parameter values with the corresponding Spec and C_limit thresholds).

Full CMR Report Page

The full CMR Report page provides full details of the CMR values, both before and after theoretical shift application, and uses Tables 2, 13, 15. The page contains the following five results tables:

Maximum simplex/duplex H/V CMR, before and after shift
see example table 121, FIG. 12A % of simplex/duplex H/V CMR values out of C_limit, before and after shift
see example table 122, FIG. 12A % of simplex/duplex H/V CMR failures per page area, before and after shift
see example table 123, FIG. 12A Simplex H/V CMR values per test point, before and after shift
see example table 124, FIG. 12B
Duplex H/V CMR values per test point, before and after shift
see example table 125, FIG. 12C
Random Point Range Page
The Random Point Range page provides full details of the MR_RangePerPoint and MR_AvPerPoint values from Table 3 and 4. The page contains the following four results tables:
Simplex/duplex V MR_RangePerPoint values for colors Y, M, C
see example table 131, FIG. 13A
Simplex/duplex H MR_RangePerPoint values for colors Y, M, C
see example table 132, FIG. 13A
Simplex/duplex V MR_AvPerPoint values for colors Y, M, C
see example table 133, FIG. 13B
Simplex/duplex H MR_AvPerPoint values for colors Y, M, C
see example table 134, FIG. 13B
The following report-page-specific alert messages are output if the relevant reported values exceed their corresponding Spec thresholds:
High Y/C/M V separation MR_RangePerPoint detected
High V separation MR_AvPerPoint detected
High H separation MR_AvPerPoint detected.
Separation View, Dress and Jacket Page
The Separation View, Dress and Jacket page provides a view of the shift values for each separation as well as giving the dress and jacket values. This page uses Tables 5-11 and presents the following four results tables:
Maximum Horizontal simplex/duplex L,R Shift for the Y separation
max Dress value is also included
see example table 141, FIG. 14
Maximum Vertical simplex/duplex Shift for the Y separation
max VShiftRange and Jacket values are also included
see example table 142, FIG. 14
Maximum Vertical simplex/duplex Shift for the M separation
max VShiftRange value is also included
see example table 143, FIG. 14
Maximum Vertical simplex/duplex Shift for the C separation
max VShiftRange value is also included
see example table 144, FIG. 14
The following report-page-specific alert messages are output if the relevant reported values exceed their corresponding Spec thresholds:
High Y separation H shift detected
High Dress effect detected
High Y separation V shift detected
High M/C separation V shift detected
High Jacket effect detected
Theta Parameters Page
The Theta Parameters page provides full details of the theta-related results using Tables 16-21. The page contains the following three results tables and four results graphs:
Simplex/ duplex theta percentage values, all pages and all colors
see example table 151, FIG. 15A
Frequency-amplitude values of FT of theta values, M and K colors only
see example table 152, FIG. 15A
Theta polynomial fitting, all pages, M and K colors only
see example table 153, FIG. 15B
Graph of theta values as a function of distance from leading edge, for color M
see example graph 154, FIG. 15C
Graph of theta values as a function of distance from leading edge, for color K
see example graph 155, FIG. 15C
Graph of theta values as a function of distance from leading edge, for color Y
see example graph 156, FIG. 15C
Frequency-amplitude graph for FT of theta values, M and K colors only
see example graph 157, FIG. 15C It will be appreciated that many variants are possible to the described example embodiment. For example, the order of processing of the raw MR data, the set of parameters derived from that data, and the form of presentation of the results of the analysis step 36 are all subject to variation from the example embodiment described above, being to some extent dependent on the printing system involved and what types of MR issues are of concern. For example, in the report it may be decided to include the VbasicAfterShift and HbasicAfterShift values as well as, or instead of, the VCMRAfterShift and HCMRAfterShift values.

In addition, the form and layout of the test-point and theta markings on the test sheets can be varied from that illustrated and described—for example, the test points can be of two types, one type for measuring vertical mis-registration and the other type for measuring horizontal mis-registration. A different number of test sheets can be used from the four sheets employed in respect of the example embodiment.

The invention claimed is:

1. A method of assessing the operation of a color printing system, comprising:
printing a multi-sheet test job with corresponding test points on each sheet distributed vertically and horizontally over the sheet, the test points comprising test markings for enabling measurement of horizontal and vertical color plane registration for each of multiple printing colors;
measuring the printed test markings at the test points to determine for said printing colors a multiplicity of horizontal and vertical color plane misregistration values;
analyzing the multiplicity of misregistration values to derive a plurality of misregistration parameters providing different respective views of misregistration behavior across the test sheets; and
providing an output based on the misregistration parameters,
wherein each test sheet includes a printed vertical series of markings for enabling measurement of a sequence of vertical misregistration values that are 'theta values' for at least some of the printing colors, the measuring step comprising measuring the vertical series of markings to determine a sequence of theta values for one or more of the printing colors, and the analyzing comprising deriving from the theta values theta-related parameters including the amplitudes of spatial frequency components present in the theta values.

2. A method according to claim 1, wherein said multiplicity of horizontal and vertical color plane misregistration values are determined for said multiple printing colors relative a reference formed by the color plane of a further printing color.

3. A method according to claim 1, wherein the misregistration parameters derived from analyzing the multiplicity of misregistration values, include a CMR parameter that is derived as the maximum, per test point, of the color-to-color misregistration values for all printing colors.

4. A method according to claim 3, wherein the misregistration parameters derived from analyzing the multiplicity of misregistration values, comprise at least one of:

the percentage of the horizontal and/or vertical color plane misregistration values exceeding corresponding predetermined threshold values, and the percentage of the CMR parameter values exceeding corresponding predetermined threshold values.

5. A method according to claim 1, wherein the misregistration parameters derived from analyzing the multiplicity of misregistration values, comprise at least one of:

for each set of corresponding test points across the test sheets, the range of misregistration values; and for each set of corresponding test points across the test sheets, the average misregistration values.

6. A method according to claim 1, wherein the analyzing of the multiplicity of misregistration values further involves determining different types of printing-system fault from the values of the misregistration parameters.

7. A method according to claim 1, wherein the analyzing of the multiplicity of misregistration values further involves comparing values of the misregistration parameters with corresponding thresholds to control the generation of alerts indicating the presence of one or more types of printing-system fault.

8. A method according to claim 1, wherein the analyzing of the multiplicity of misregistration values further involves deriving, for at least one printing color, both:

a color plane shift that can be applied by the printing system to generally minimize at least one of horizontal and vertical misregistration of the corresponding color plane; and predicted misregistration parameter values after application of that shift.

9. A method according to claim 8, wherein the report includes values of the same misregistration parameter both before and after application of the derived col or plane shift.

10. A method according to claim 9, wherein color plane shift, and predicted misregistration parameter values after application of that shift, are derived for said multiple printing colors, the misregistration parameter for which both before-shift and after-shift values are reported being the maximum color-to-color misregistration at each test point.

11. A method according to claim 1, wherein said output is a report of misregistration behavior.

12. Apparatus for of assessing the operation of a color printing system, comprising:

an imaging subsystem for receiving a multi-sheet test job printed by the printing system with corresponding test points on each sheet distributed vertically and horizontally over the sheet, the test points comprising test markings for enabling measurement of horizontal and vertical color plane registration for each of multiple printing colors, the imaging subsystem being arranged to image the test job sheets and measure the printed test markings to determine for said printing colors a multiplicity of horizontal and vertical color plane misregistration values; and a processing subsystem arranged to:

analyze the multiplicity of misregistration values to derive a plurality of misregistration parameters providing different respective views of misregistration behavior across the test sheets; and generate an output based on the misregistration parameters, wherein the processing subsystem, in analyzing the multiplicity of misregistration values, is arranged to derive, for at least one printing color:

a color plane shift that can be applied by the printing system to generally minimize at least one of horizontal and vertical misregistration of the corresponding color plane; and predicted misregistration parameter values after application of that shift.

13. Apparatus according to claim 12, wherein the processing subsystem is further arranged to compare values of the misregistration parameters with corresponding thresholds to control the generation of alerts indicating the presence of one or more types of printing-system fault.

14. A method of assessing the operation of a color printing system, comprising:

printing a multi-sheet test job with corresponding test points on each sheet distributed vertically and horizontally over the sheet, the test points comprising test markings for enabling measurement of color plane registration for each of multiple printing colors;

measuring the printed test markings to derive misregistration values for said printing colors;

determining, for at least one printing color, a color plane shift that can be applied by the printing system to generally minimize misregistration of the corresponding color plane; and predicting misregistration values at the test points after application of the determined shift.

* * * * *